US005842961A

United States Patent [19]

Davis

[11] Patent Number: 5,842,961

[45] Date of Patent: Dec. 1, 1998

[54] EXERCISE MACHINE

[75] Inventor: James O. Davis, Oceanside, Calif.

[73] Assignee: The Jim Davis Connection, LLC, Carlsbad, Calif.

[21] Appl. No.: 510,796

[22] Filed: Aug. 4, 1995

[51] Int. Cl.[6] ..... A63B 21/16

[52] U.S. Cl. ..... 482/139; 482/99; 482/102; 482/103

[58] Field of Search ..... 482/38, 39, 41, 482/42, 45, 46, 70, 72, 99, 102, 103, 120, 124, 126, 129, 138, 139, 148, 904; D21/196

[56] References Cited

U.S. PATENT DOCUMENTS

| | | | |
|---|---|---|---|
| D. 262,814 | 1/1982 | Lambert, Jr. et al. | D21/198 |
| D. 290,485 | 6/1987 | Suponitsky . | |
| D. 317,032 | 5/1991 | Eckler | D21/198 |
| D. 320,636 | 10/1991 | Eckler | D21/198 |
| 4,328,964 | 5/1982 | Walls | 482/129 |
| 4,826,157 | 5/1989 | Fitzpatick | 482/103 X |
| 4,836,573 | 6/1989 | Moreno | 482/139 |
| 4,934,690 | 6/1990 | Bull . | |
| 5,076,578 | 12/1991 | Askonen . | |
| 5,102,122 | 4/1992 | Plane, Jr. et al. . | |
| 5,328,430 | 7/1994 | Vittone et al. | 482/99 X |
| 5,419,749 | 5/1995 | Morgenstein | 402/103 X |

FOREIGN PATENT DOCUMENTS

| | | | |
|---|---|---|---|
| 529810 | 9/1956 | Canada | 482/904 |

OTHER PUBLICATIONS

Power Systems© 95 Catalog.

Article by Steve Scholfield Published in the Blade–Citizen, Oceanside, California October 1994.

Article by Brian Barry, M.A., A.T.C., A.T.C., O.P.A.–C, Published in San Diego Sports & Fitness, May/Jun., 1995.

Article by Jack Williams Published in the San Diego Union–Tribune, Sunday Aug. 7, 1994.

*Primary Examiner*—Lynne A. Reichard
*Assistant Examiner*—John Mulcahy
*Attorney, Agent, or Firm*—Lyon & Lyon, LLP

[57] ABSTRACT

An adjustable resistance exercise machine including a pulley system and a cable connecting a handle to a weight. The handle is shaped to permit a free range of motion and an essentially unlimited number of exercises. Specifically, the handle is an angulated non-planar J-shaped tubular rod having a first end portion forming the stem of the J, and at least three segments forming the loop of the J. The second end portion of the rod forms the last segment of the loop of the J and lies in a first plane with the adjacent segment. The first end portion and the first segment lie in a plane at an angle to the first plane. A body engaging member is rotatably mounted on the first end portion of the tubular rod. The body engaging member may be a sleeve for the user to grip or a cuff for strapping onto various pats of the user's body, e.g., the foot or ankle.

16 Claims, 21 Drawing Sheets

EXERCISE MACHINE

BACKGROUND OF THE INVENTION

This invention relates to a multi-purpose exercise machine for performing exercises against variable resistance. More specifically this invention relates to an exercise machine with a guided pulley system in combination with one or more body engaging assemblies which permits the user to perform functional full-range of motion exercises against a selectable resistance.

Exercising against variable resistance has therapeutic benefits, including improvements in strength, neuromuscular coordination, and cardiovascular and respiratory efficiency. In addition to usefulness in conditioning and training programs, exercises against variable resistance are also useful in rehabilitation and preventative therapy.

Other forms of therapy include proprioceptive neuromuscular facilitation (PNF) therapy. Physical therapists use PNF therapy to alternately contract and stretch the muscles of the patient, while avoiding overloading of the joints.

Preventative exercise has been proven to slow the onset of arthritis. Currently in the United States, nearly one person in five—38 million individuals—suffer from arthritis. Arthritis currently costs the U.S. economy more than $54 billion per year, and the Center for Disease Control notes that arthritis is already the leading cause of disability in people over 65.

Despite the benefits of preventative exercise therapy which include decreasing pain and increasing functional capacity, many people do not start or maintain exercise programs because they are intimidated and/or not capable of traditional forms of exercise routines. Therefore, it is important to develop exercise programs which can be adapted for use by individuals of all ages and levels of fitness.

A variety of guided pulley variable resistance weight training machines have been described and are currently available in the marketplace. These machines utilize a number of means to provide variable resistance.

To obtain variable resistance "Universal" machines utilize one or more weightstacks of heavy metal plates which are connected to a cable and pulley system. Resistance is varied by selecting the number of weights connected to one end of the cable system. Pulleys guide the cable to various locations of the device, depending on the exercise being performed.

The second end of the cable is connected to a body engaging assembly which can be engaged by the exerciser to actuate the exercise device. The cable system is arranged so that movement of the body engaging assembly in one direction results in upward planar movement of the weights connected to the cable with respect to the frame of the machine. Movement of the body engaging assembly in the opposite direction to return the body engaging assembly to the initial rest position results in downward movement of the weights connected to the cable. Resistance is created by the force of gravity on the weights attached to the cable, which is transmitted through the cable system to the body engaging assembly. Because the resistance is independent of the extent of displacement of the body engaging assembly, for each selected amount of weight, resistance is essentially constant through the range of motion permitted by the particular apparatus.

Weightstack exercise machines have a safety advantage over free weights traditionally used to perform variable resistance exercises. Weightstack exercise machines restrict the movement of the weights into a single plane away from the exerciser, so that the weights cannot fall on the user.

A guided pulley weightstack resistance system permits the user to perform both concentric exercises and eccentric exercises. In concentric exercises, or positive resistance exercises, the body engaging assembly is moved from the resting position by shortening the muscles used to move the body engaging assembly. In eccentric exercises, or negative resistance exercises, the muscles used to move the body engaging assembly from its rest position lengthen as the muscles resist the return of the body engaging assembly to rest position under the force of gravity.

Guided pulley weightstack machines, however, are typically limited in the range of movements which can be performed. Generally these machines are designed to permit the user to perform one or more exercises in which each exercise isolates one muscle or muscle group.

In addition, even a machine designed to permit a range of natural movements will restrict, or interfere with, the movements of the user in the absence of a proper body engaging assembly. Natural movements typically coordinate the use of several muscle groups. Although the guided weight resistance force actually remains constant throughout the exercise, during the course of a natural movement, the total resistance is distributed among more than one muscle group. Natural movements performed with handles which have been previously described or sold will result in the temporary isolation or partial isolation of muscle groups, causing a restriction in the user's movement as the isolated muscles strain to overcome the temporary apparent increase in resistance.

Other guided pulley exercise machines substitute other means of providing variable resistance for the weightstack. These machines are also generally limited in the range of movements which can be performed, and are typically designed to perform exercises which isolate one muscle or muscle group.

Some machines utilize pneumatic or hydraulic pressure resistance in which force exerted by the user forces a gas or liquid from one chamber to another. In the hydraulic and pneumatic resistance systems, resistance is varied by changing the position at which the resistance system is attached to the body engaging assembly. Use of pneumatic or hydraulic pressure systems provides a low inertia variable resistance which minimizes the force necessary to start and stop movement of the body engaging assembly.

In exercises performed against a hydraulic or pneumatic resistance system the resistance increases as the force exerted by the user increases, rather than remaining constant as in exercises performed against a weightstack resistance source. In addition, with pneumatic or hydraulic resistance sources, the gas or liquid returns to the original chamber very slowly in the absence of force. Consequently, after moving the body engaging assembly from its rest position, the user must either await the return of the body engaging assembly to its rest position, resulting in inefficient delays in the exercise program, or the user must use positive resistance movement to return the body engaging assembly to its rest position. As a result, one set of muscles carries out positive resistance exercises to move the body engaging assembly from its rest position, while the opposing set of muscles performs positive resistance exercises to return the body engaging assembly to its rest position. Hydraulic and pneumatic resistance exercise machines therefore do not provide the benefits obtained from combining concentric and eccentric exercises, but they do permit the user to work opposing sets of muscle groups for each exercise performed.

Another system for creating variable resistance is the centrifugal brake system in which friction pads attached to a pulley are in contact with brake shoes. When the user moves a body engaging assembly attached to a cable wound around the pulley, the pulley spins and the brake shoes rub against the pads. As with the hydraulic systems, the friction of the brake shoes against the pads increases with increasing force exerted by the user of the machine. However, unlike the hydraulic or pneumatic resistance source, once the user stops exerting force, the system quickly returns to its resting position.

Still another way to create variable resistance is through the use of flexible rods connected to a cable system. Changing the number or thickness of the rods connected to the cable varies the resistance. Once the user stops exerting force on the body engaging assembly, the rods return to their natural shape, and the body engaging assembly returns to its rest position. Flexible rod resistance systems permit the user to perform both concentric and eccentric exercises. However, flexible rod resistance sources create progressive resistance for each chosen configuration of rods, because the farther the rod is bent, the greater the resistance.

One commercially available exercise apparatus is the ALLIANCE™ Hi-Lo Cable Column Rehabilitation System produced by Chattanooga Group, Inc. (4717 Adams Road, P.O. 30 Box 489, Hixson, Tenn., 37343-0489). This device consists of an upright frame, a graduated weightstack starting at 10 lbs., a line of tension which can be adjusted to 7 possible vertical positions, and changeable hand grip pieces including a triangular hand grip piece designed to pivot 180 degrees. However, the Hi-Lo Cable Column does not provide a leg engaging device or an arm engaging device with a proper asymmetric configuration to provide smooth, unrestricted movement through a full range of motion. Furthermore, the 10 lb. weight increments may be too large to permit beginning or pain sensitive users to perform full range movement exercises without the risk of overloading the joints and musculature. Moreover, the Hi-Lo Cable Column does not have attached adjustable handrails which facilitate natural full range of motion exercises while standing.

Another commercially available exercise apparatus is the Lifeline Gym produced by Lifeline International (1421 South Park Street, Madison, Wis. 53715). This apparatus includes a rubber tubing resistance source to be used in conjunction with a door. The rubber tubing can be twisted to provide variable resistance in a number of exercises for both upper and lower body. However, the body engaging assemblies of this device are a straight bar for upper body exercises and foot stirrups for lower body exercises. Although this apparatus would permit a range of movements, the body engaging assemblies would not allow smooth movements throughout the entire full range of motion exercises. In addition, because each twist of the rubber band simulates the addition of a ten pound weight, the available increments of variable resistance may also be too large to permit inexperienced or pain sensitive users from performing exercises encompassing a full range of motion without overloading the joints and muscles.

U.S. Pat. No. 5,102,122 describes a cable drawn flexible rod resistance exercise machine designed to "allow[] the user the ability to utilize the entire body in full-range exercise, sports-specific motion and work-specific motion." However, the patent does not specifically disclose use of the machine with body engaging assemblies which are properly shaped to permit natural, unrestricted, smooth movement over a full range of motion. Therefore, the movements permitted by that machine using previously described handles would not be smooth and unrestricted. In addition, the apparatus described in this patent does not have attached adjustable handrails which would provide support during while performing free range of motion, natural exercises while standing.

The exercise machine patented in U.S. Pat. No. 4,934,690 describes a climbing machine for use of individuals of all ages, body types, and skill levels, intended to provide a rhythmic, fluid exercise motion. However, the design of that machine limits the range of movements available to the user. In addition, that machine is not a cable drawn resistance machine and is not suitable for performing eccentric and concentric exercises.

Variously shaped body engaging assemblies for use with exercise machines are also commercially available. For instance, the POWER SYSTEMS® 95 catalog describes a revolving curl bar (page 7, item 4 under "Machine Bars and Handles") which is a 7 segment bar having obtuse angles between each pair of segments, and a central sleeve with a cable connector. The sleeve permits rotation of the bar within the sleeve along the longitudinal axis of the bar.

In addition, the catalog describes a chrome multi-handle bar (page 7, item 7 under "Machine Bars and Handles") which is a 5 segment bar in which the middle three segments are angled approximately like three sides of a hexagon and lie in a plane substantially orthogonal to the plane in which the two end segments lie. The chrome multi-handled bar also contains a sleeve over the middle segment to which a cable connector is attached. However, the bends in these handles are not properly angled to permit smooth unrestricted natural movements while holding the handle with both hands. In addition, the segments of these handles which are grasped by the user lack body engaging members which can rotate about the longitudinal axis of those segments of the handles.

Furthermore, available single grip handles would also not permit smooth, unrestricted full range of motion movements. For instance, a single grip handle is available in the POWER SYSTEMS® 95 catalog (page 7, item 10 under "Machine Bars and Handles"). This single grip handle is rectangular in shape, where the portion to be gripped corresponds to one of the long sides of the rectangle. However, this grip lacks the necessary three dimensional shape to permit a smooth, unrestricted movement over a full range of motion.

Another grip is featured for use with the ALLIANCE Hi-Lo Cable Column. This grip appears to be a roughly triangular shaped handle capable of rotating 180°. Again, this handle configuration would not be sufficient to permit smooth, unrestricted movement throughout the course of natural movements.

Other angulated handles for use with exercise devices are described in U.S. Pat. No. 5,076,578, U.S. Pat. Des. 262,730, U.S. Pat. Des. 262,814, U.S. Pat. Des. 290,485, U.S. Pat. Des. 317,032, and U.S. Pat. Des. 320,636. These exercise handles appear to be suitable primarily for use in exercises which isolate muscles of the arms, chest or back, while the user grasps the handle with both hands. None of these handles contains the proper conformation to permit natural movements which are smooth and unrestricted throughout the entire range of motion. Furthermore, none of these handles or the commercially available handles designed to be grasped by both hands contains rotating sleeves on the portions of the handles which the user grips.

Therefore, although a variety of exercise machines and handles for actuating the exercise machines have been sold or described, none have been described which permit unrestricted, smooth, natural, full-range movements. These types of exercises have been unachievable with the use of previously described body engaging assemblies. Insuring unrestricted movement through a full range of motion is important to avoid stress on joints and muscles which may result from contraindicated movements. This is particularly important in rehabilitative and preventative exercise programs in which ballistic, jerky, stressful movements can interfere with therapeutic results, or cause further injury.

SUMMARY OF THE INVENTION

It is the object of this invention to provide an exercise device utilizing a body engaging assembly which permits smooth, unrestricted, full range of motion movements of the joints and muscles, and which does not permit contraindicated motion for joint and muscles. It is a further object of this invention to provide an exercise machine which permits unlimited natural, functional, and full range of motion movements of joints and muscles without interference from the machine. Still another object of this invention is to provide an exercise machine which permits non-linear, e.g., diagonal patterns of movement, and which does not limit the user to traditional linear patterns of exercise which isolate a muscle or muscle group. Furthermore, it is an object of this invention to provide an exercise machine which permits an evenly distributed level of resistance through the full range of motion and avoids temporary isolation of a muscle or muscle group during a full range of motion movement.

It is also an object of this invention to provide a variable resistance exercise machine which can be used by any age and skill level. Still another object of the invention is to provide an apparatus and body engaging assemblies which permit a wide variety of exercises for improving flexibility and aerobic conditioning.

The exercise apparatus of this invention can be used for a variety of purposes, e.g., recreation, prevention and rehabilitation. The devices of this invention are also useful, for example, in rehabilitation programs for injured individuals, or to improve the performance of recreational or professional athletes. Furthermore, when the exercise machine incorporates a resistance source permitting both concentric and eccentric exercises, the exercises can provide similar therapeutic effects as those from PNF therapy. In addition, by performing the concentric and eccentric exercises against a resistance force, the therapeutic benefits can be achieved more quickly than with traditional PNF therapy.

It is an additional object of this invention to provide an exercise apparatus in which the height of the cable guides can be adjusted to accommodate users of varying heights, to change the muscle groups worked, and to avoid interference with movement of the cable during full range of motion exercises. The exercise device preferably contains a guided cable pulley system preferably having a height adjustment device to permit the height of the pulleys to be adjusted in order to change the path of the cable.

Another object of this invention is to provide an exercise machine having handrails to help support the user during exercise. The handrails are preferably detachable, and adjustable, so they can easily be positioned to provide support to the user in a variety of exercises, or removed to increase the exercise floor space when the user does not require handrail support.

The exercise apparatus is designed for engagement by one part of the user's body at a time. However, where it is desirable to simultaneously engage more than one part of the user's body, two body engaging assemblies connected to separate resistance sources may be used. These two resistance sources may be provided either by two separate exercise machines arranged in close proximity at a desired angle from one another, or they may be provided by one unit incorporating two resistance sources, e.g., two weightstacks and two guided cable pulley systems.

It is a further object of this invention to provide body engaging assemblies which are capable of use with different sources of guided cable variable resistance, and in a variety of environments. For instance, the body engaging assemblies may be adapted for use in space, in combination with a pneumatic or hydraulic resistance system. In addition, such limb engagement devices may be useful in water therapy programs.

The body engaging assemblies of this invention can be used with exercise devices to permit smooth, unrestricted, natural full range of motion patterns of movement by various regions of the body. Preferably the body engaging assembly will be used with a cable drawn resistance source in which cables run over a guide device, preferably pulleys, to the body engaging assemblies. The resistance source may be, for example, weightstack, hydraulic, pneumatic, or flexible rod. Preferably the machine will incorporate a guided pulley weightstack system.

The shapes of the body engaging assemblies of this invention allow smooth, unrestricted, rhythmic, natural movements through a constantly improving functional pattern. Exercises performed with these body engaging assemblies result in therapeutic results such as increased joint and soft tissue range of motion, increased strength, increased power and endurance, increased flexibility and range of motion, and decreased overall soreness.

The body engaging assemblies of this invention contain a non-planar tubular rod, i.e., a tubular rod in which the path of the tubing lies in more than one plane. The body engaging assemblies may be constructed by bending one piece of tubing or by fixably attaching smaller pieces of tubing corresponding to different segments of the tubular rod in order to form a unitary tubular member having a proper shape, i.e., a shape which permits smooth, unrestricted full range of motion movements. Preferably, the body engaging assemblies are formed by bending a single piece of tubing into the correct shape. More preferably, the tubular members will be constructed by bending stainless steel tubing with an outer diameter of 0.75 inches and a wall thickness of 0.62 inches.

When engaged by a part of the body, the body engaging assemblies permit smooth, unrestricted, natural movements of the engaged body part in which resistance is evenly distributed over a full range of motion. These movements can encompass the full range of motion permitted by the joints and musculature of the user. Exercises performed using the body engaging assemblies of this invention avoid isolating a single muscle or muscle group which could disrupt a smooth motion and restrict movement. The body engaging assemblies contain a tubular member, a body engaging member which is contacted by the user's body, and a cable connector in order to connect the body engaging assembly to the cable of a cable drawn exercise machine.

The body engaging member is the part of the body engaging assembly which comes into physical contact with the user's body during use. The body engaging member is preferably rotatable about the longitudinal axis of the segment of the tubular member to which it is attached.

For example, where the engagement is with the user's hand, the body engaging member is preferably a grip seated on a terminal segment of the tubular portion of the body engaging assembly in a manner that the permits the grip to rotate about the longitudinal axis of that segment of the body engaging member. More preferably, this body engaging member grip will be a sleeve rotatably seated on a segment at one end of the tubular member. Even more preferably, this body engaging member grip will be padded for the comfort of the user.

Where the user does not engage the body engaging assembly with a hand, the body engaging member preferably is a cuff or strap or set of cuffs or straps rotatably attached to a terminal segment of the tubular member, and which is rotatable about the longitudinal axis of that segment of the tubular member. These straps may be made of various materials, e.g., cloth or leather, and may have various types of fasteners, e.g., VELCRO® or buckles. In addition, these straps may be padded to provide comfort for the user. More preferably the body engaging member is a set of padded nylon straps with VELCRO® closures.

Exercises performed with the body engaging assemblies of this invention are particularly well suited for use by individuals who cannot tolerate and/or are intimidated by traditional weight lifting exercises employing linear, stressful, ballistic, jerky motions causing a sudden increase in the apparent resistance encountered by muscles or joints, and employing overload principles of training, conditioning and rehabilitation. For instance, the body engaging assemblies of this invention can be used by physically challenged patients, such as wheelchair bound patients, cardiac patients, or mentally retarded patients. In addition, the device will be useful for those suffering from orthopedic and arthritic conditions.

In addition, the absence of sudden increases in the resistance experienced by the muscles or joints insures that all individuals can use the exercise machine of this invention with minimal risk of injury or aggravation of an existing injury or condition, regardless of the individual's skill or age level.

Although the following detailed description describes engagement of the body engaging assemblies with either the arms or legs of the user, the full range of motion movements permitted by these body engaging assemblies permit exercise of other body regions such as the trunk and lumbarthoracic region, neck, hips, shoulders, chest and back while moving the part of the body engaging the body engaging assembly. In addition, body engaging assemblies can be adapted for engagement of other parts of the body in addition to the arms and legs.

BRIEF DESCRIPTION OF THE DRAWINGS

FIG. 9 shows various perspectives of a body engaging assembly for engaging a left foot.

The tubular portion is a mirror image to the tubular portion of the left foot engaging assembly. Elements common to those shown in FIGS. 1–8 have been like numbered.

FIG. 11 shows various perspectives of a body engaging assembly for engaging the left hand.

Figure 11E:
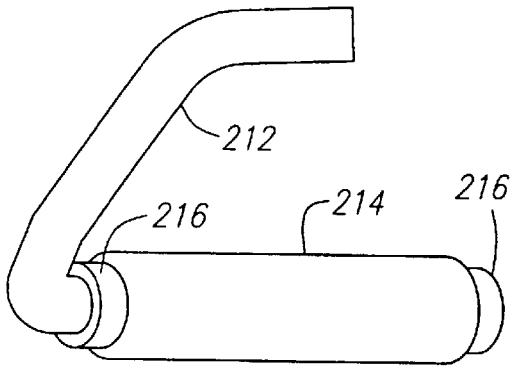
Figure 11F:
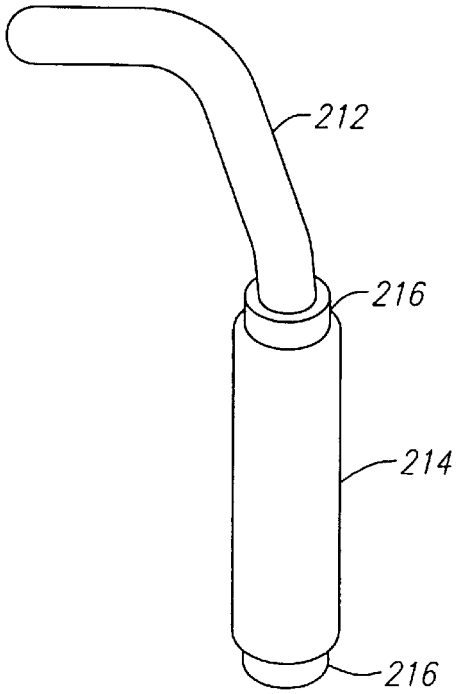
Figure 11G:
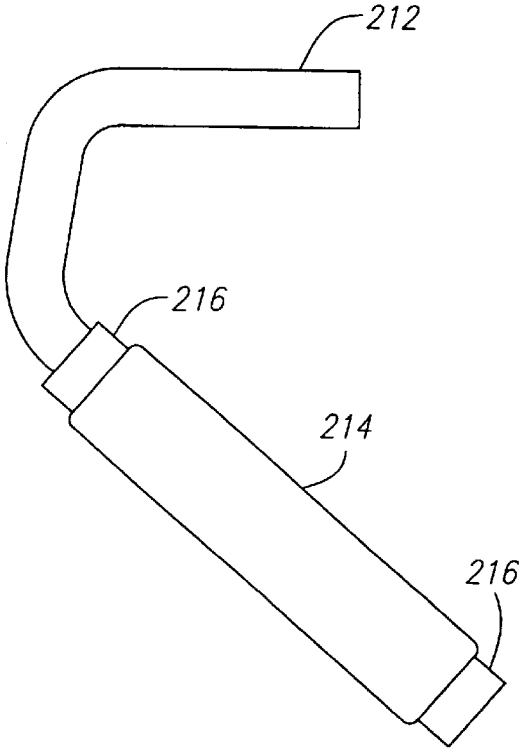
Figure 11A:
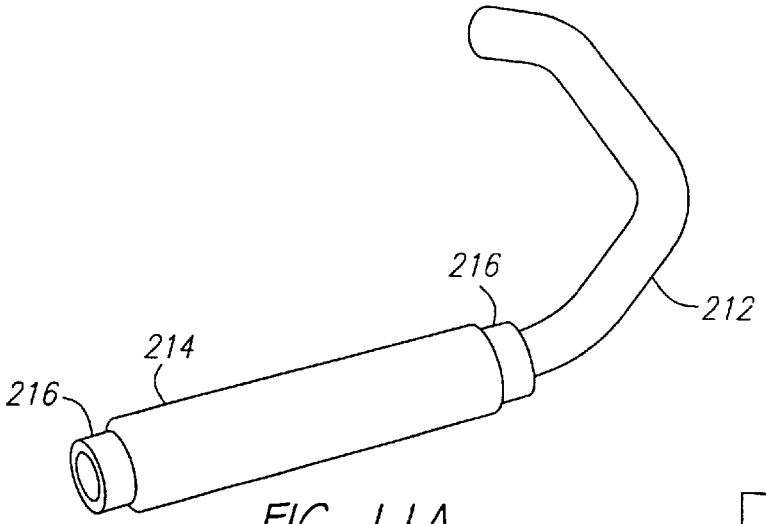
Figure 11B:
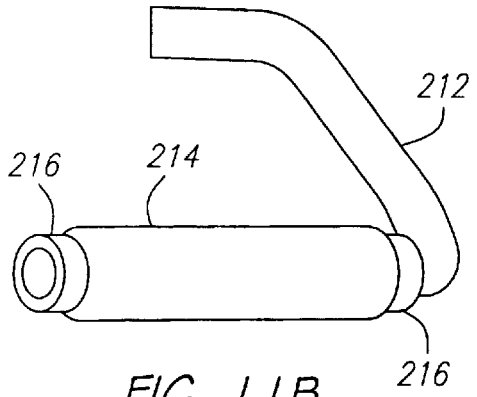

FIG. 11A is an elevational perspective view of the left hand engaging assembly.

Figure 11C:
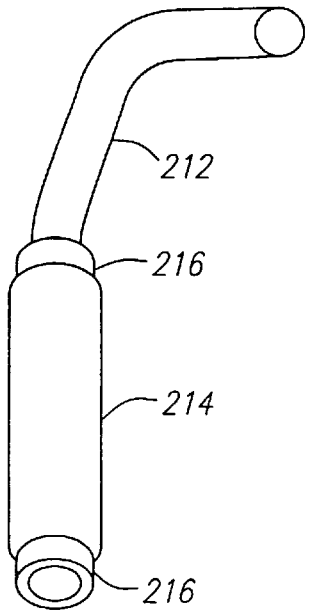
Figure 11D:
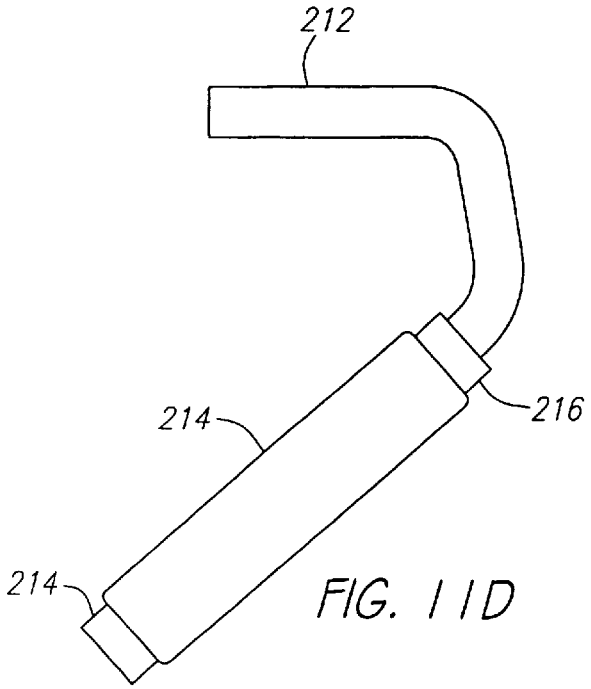

FIG. 11D is a front view of the left hand engaging assembly.

FIG. 11E is a bottom view of the left hand engaging assembly.

FIG. 11C is the left side view of the left hand engaging assembly.

FIG. 11E is a top view of the left hand engaging assembly.

FIG. 11F is the right side view of the left hand engaging assembly.

FIG. 11G is a rear view of the left hand engaging assembly. Elements common to those shown in FIGS. 1–8 have been like numbered.

Figure 12A:
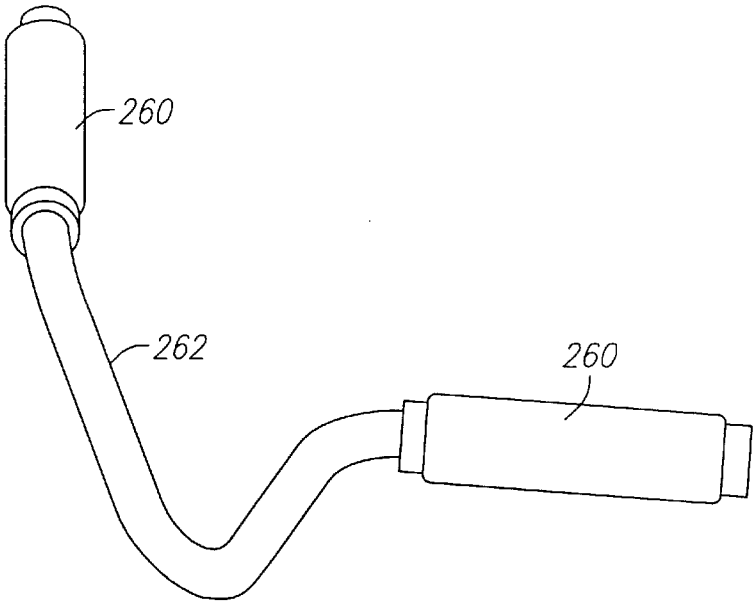

FIG. 12A shows an elevational perspective of a body engaging assembly to be grasped with both hands while in use.

Figure 12B:
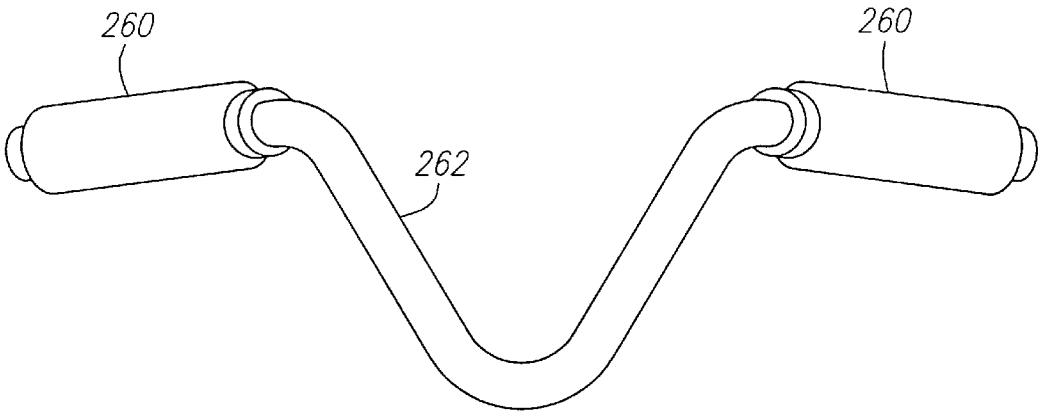

FIG. 12B shows a front view of the two hand engaging assembly.

Figure 12C:
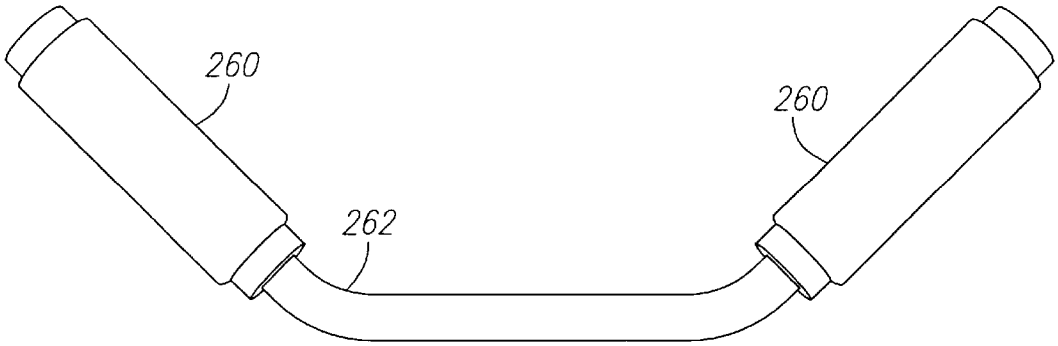

FIG. 12C shows a top view of the two hand engaging assembly.

Figure 12D:
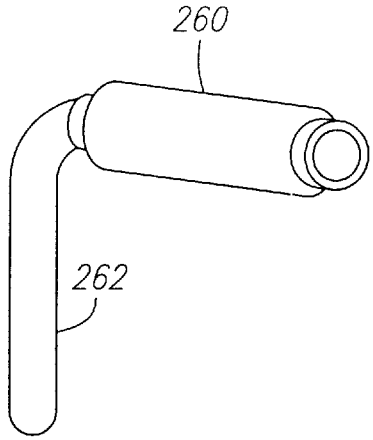

FIG. 12D shows a left side view of the two hand engaging assembly; the opposite side view being a mirror image.

Figure 12E:
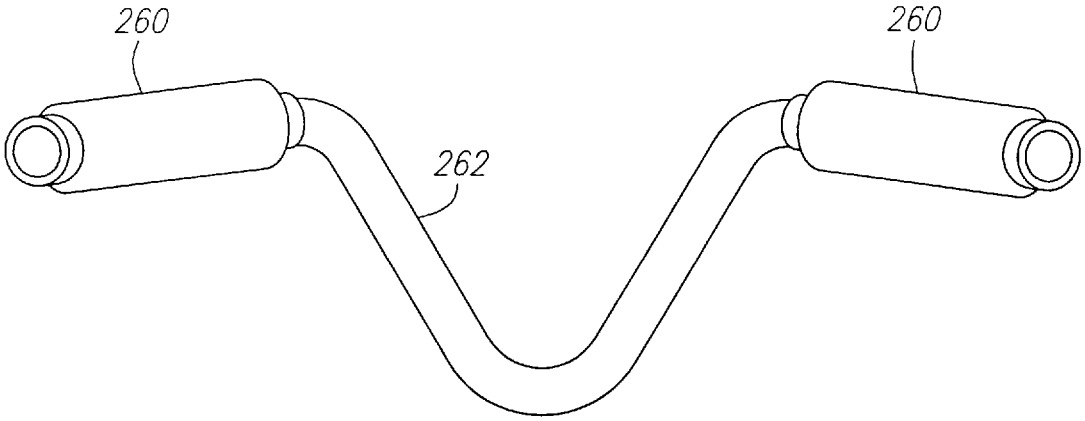

FIG. 12E shows a rear view of the two hand engaging assembly.

Figure 12F:
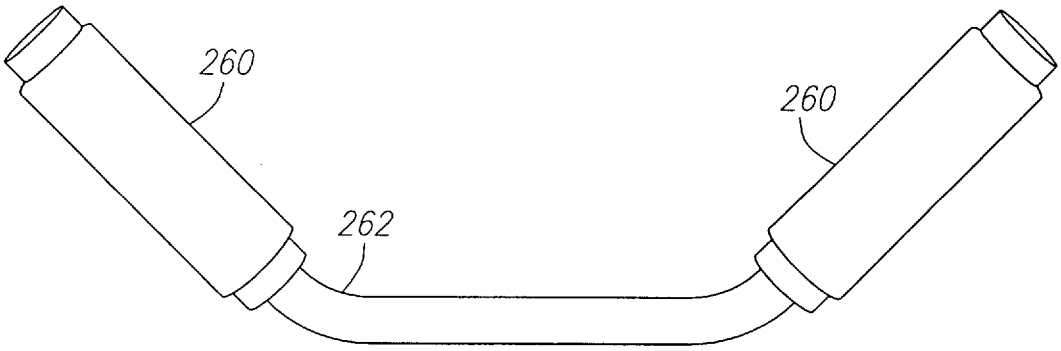

FIG. 12F shows a bottom view of the two hand engaging assembly. Elements common to those shown in FIGS. 1–8 have been like numbered.

FIG. 13A–J illustrate various exercises which can be performed with the exercise machine and body engaging assemblies of this invention.

DESCRIPTION OF THE PREFERRED EMBODIMENT

Figure 1:
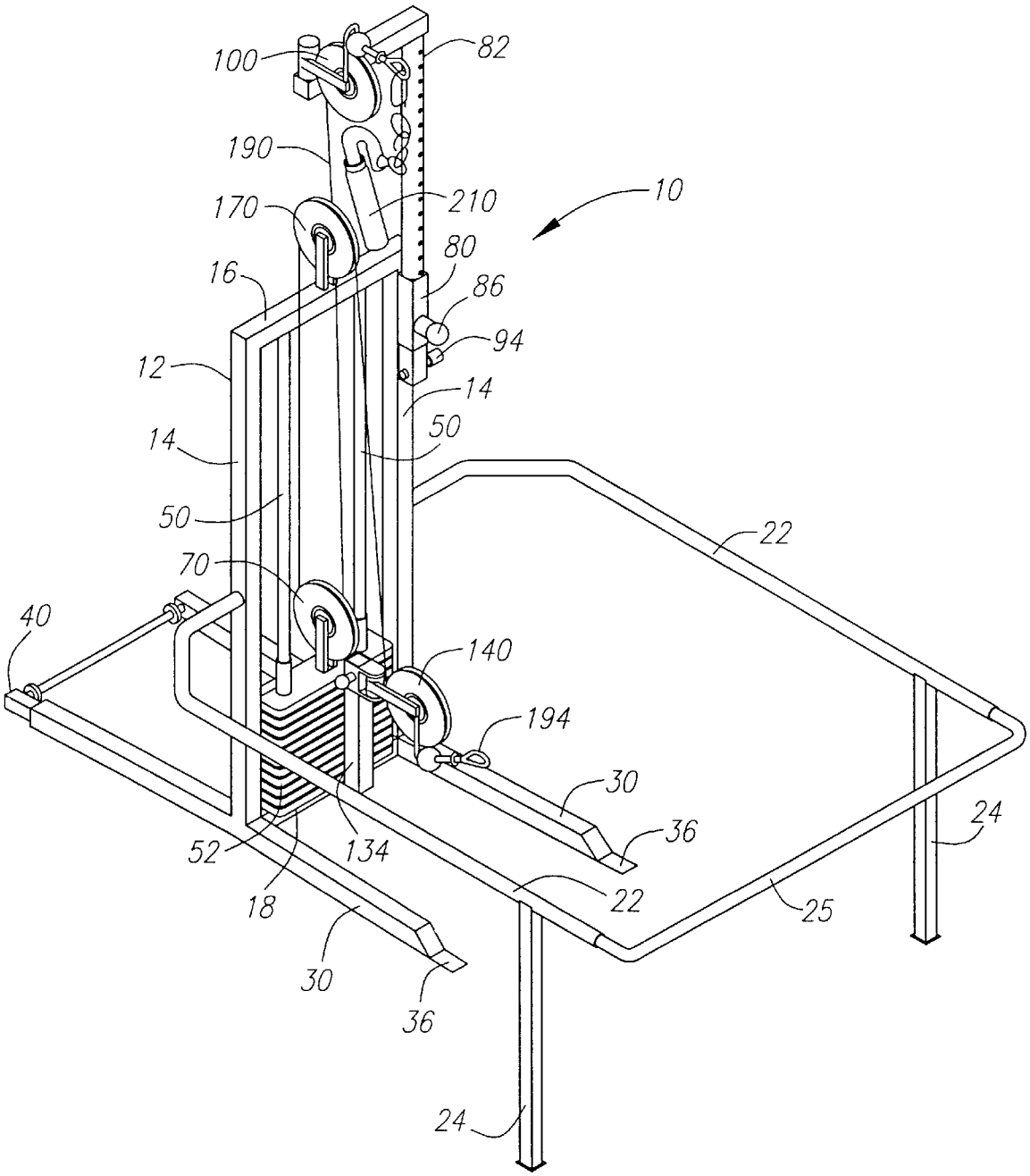
FIGS. 1 and 2 are front elevational views from slightly different perspectives showing different arrangements of the adjustable handrails.

Referring to the drawings more particularly by reference numbers, FIG. 1 which shows a perspective view of a multipurpose exercise machine 10 of the present invention in which variable resistance is provided by a weightstack. The machine 10 includes a free-standing rectangular frame 12 typically constructed of a tubular metal such as steel, which provides a strong and relatively lightweight structure. Preferably the upright frame consists of two upright beams 14 whose upper ends are connected to each end of a transverse upper cross member 16. The lower ends of the upright beams are fixably attached to the upper surface of a lower cross member 18 which rests on the support surface. The parts of the frame are connected by mechanical fasteners, adhesives or weldments, or any combination thereof which is capable of forming a frame strong enough to withstand the forces resulting from use of the apparatus. Preferably the upright beams 14 are constructed of rectangular steel tubing with a wall thickness of 0.12 inches. Preferably the upper cross member 16 is constructed of rectangular steel tubing with a wall thickness of ⅛ inches.

Figure 2:
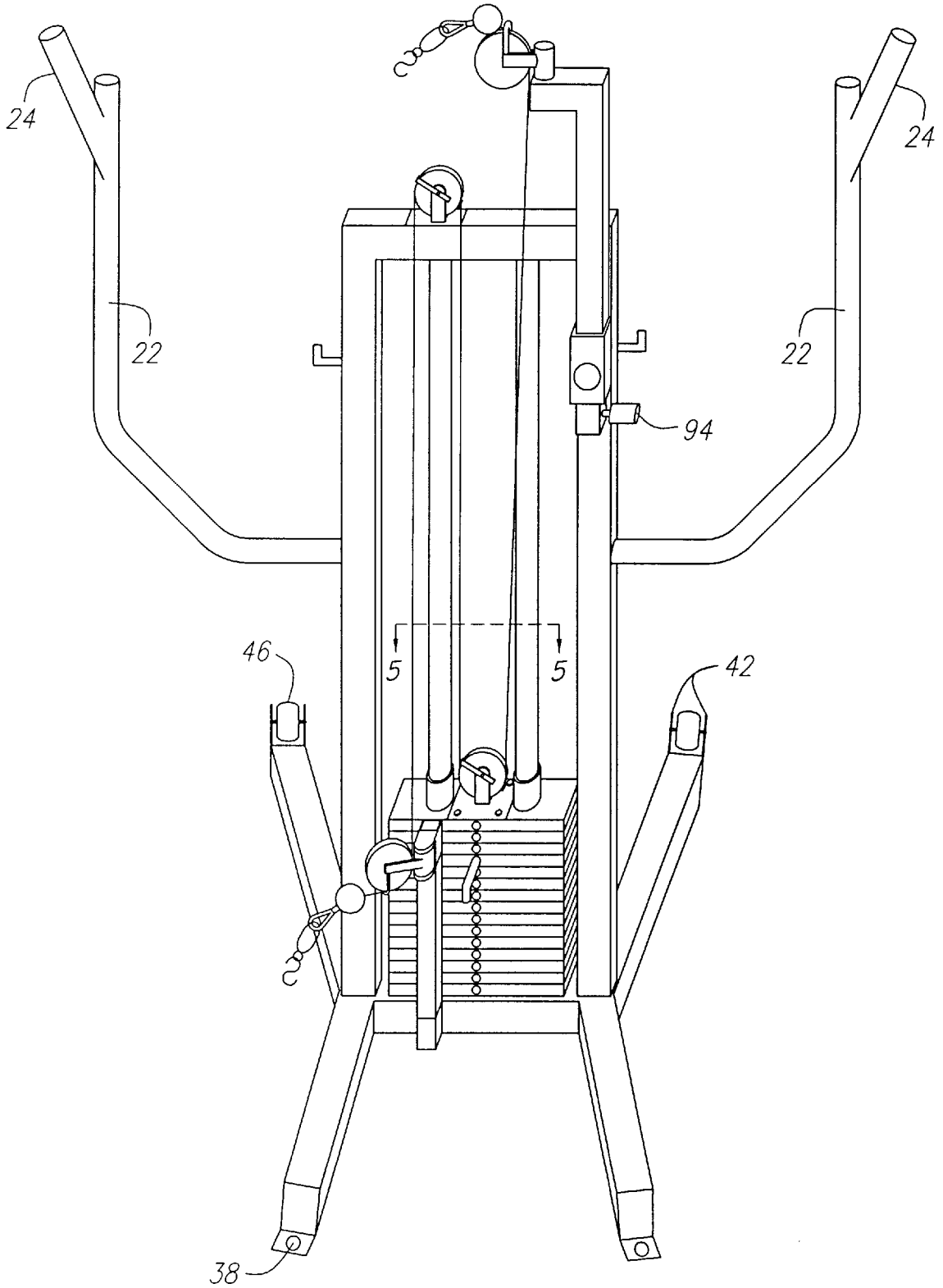

A handrail sleeve 26 is attached to the outer side of each upright beam 14 intermediate between the upper cross member and the lower cross members. The handrail sleeves 26 extend perpendicular to the upright beam. Each handrail sleeve has a hole on its upper surface to receive a handrail locking pin 28 which is self-locking. Optional handrails 22 may be inserted into the handrail sleeves. Handrails 22 have a plurality of holes 23 which may be aligned with handrail sleeve hole. Inserting handrail locking pin through the aligned holes in the handrail sleeve and the handrail fixes the handrail into position. A handrail extension 24 is rigidly attached orthogonal to each handrail near the end distal from the frame. When the handrail is positioned parallel to the ground, as in FIG. 1, the handrail extension acts as a support leg for the handrail. Handrails may also be turned upward to rest against a wall, as shown in FIG. 2. When handrails are positioned parallel to the ground, a front rail 25 transversing the handrails may be detachably mounted onto the handrails, as shown in FIG. 1. The front rail 25 has a central segment of sufficient length to transverse the distance between the handrails, and two short terminal segments perpendicular to the central segment. The ends of the handrails distal from the frame form sleeves into which the terminal segments of the front rail can be inserted. A hole near the distal end of each handrail aligns with a hole in each terminal segment of the front rail, and a self-locking pin can be inserted through the aligned holes to fix the position of the front rail with respect to the handrails. Preferably the handrails will be constructed from rectangular steel tubing with a wall thickness of ⅛ inches.

L-shaped hooks 20 may be attached to the sides of the upright beams 14 at various positions, preferably approximately 10 inches from the top of the frame. L-shaped hooks 20 can be used to hang items, for instance handrail locking pins, when not in use, for easy accessibility.

Front legs 30 are rigidly attached to the front face of the lower cross member 18 and extend along the floor at an angle partially orthogonal to the lower cross member. Rear legs 32 are attached to the back surface of the lower cross member 18 and extend along the floor at an angle partially orthogonal to the lower cross member 18. A pad (not shown) may be attached to the lower side of the rear leg to prevent skidding or marring of the flooring surface. An anchor tab 36 is rigidly connected to the front end of each of the front legs. Each anchor tab 36 has a central hole, through which a fastener can be inserted to securely anchor the base to the floor, if desired.

If the exercise apparatus is not anchored, the exercise apparatus may be moved along the floor by means of a plurality of wheel assembly units attached to the legs of the apparatus. Preferably wheel assemblies 40 are attached to the end of each rear leg 32 distal from the frame. Two wheel connector tabs 42 are attached to each rear leg. A wheel 46 is rotatably mounted on an axle transversing each pair of wheel assembly tabs.

Two vertical guide bars 50 transverse the upper and lower cross members of the frame, and are rigidly attached thereto. Weight plates 52 forming the weightstack are slideably mounted on the vertical guide bars. The guide bars guide the weight plates in the vertical direction when the weights are raised and lowered by exerting force on a cable 190 connected to the weights. Preferably the weight stack contains graduated weights. The total weight and weight graduations can be varied, depending on the strength and skill of the user. In a preferred embodiment, the graduated weightstack contains 15 1-lb. weights and fifteen 2.5 lb. weights.

The weights contain a plurality of openings to receive the guide bars and the weight increment rod. Preferably each weight plate 52 contains one central opening 54 and two guide bar openings 56 along the longitudinal axis on either side of the central opening. The guide bar openings are placed at a fixed distance from the central opening, so that when the weights are stacked, the holes in the weights are vertically aligned to form three vertical holes through the weightstack.

A lift plate 60 rests on top of the stack of weights. A weight increment rod 74 is rigidly and orthogonally attached to the lower horizontal surface of the lift plate. The weight increment rod 74 is positioned to slideably interfit into the aligned central openings of the weights. The weight increment rod 74 has a plurality of holes 76 spaced at intervals such that the holes align with openings between weight plates or with horizontal openings in the weight plates. In the preferred embodiment, the one lb. weight plates contain spacer members which create horizontal openings between each weight plate, while the 2.5 lb. weight plates have horizontal holes transversing the width of the weight plates. A selector pin 62 is provided to interfit into the horizontal openings and to insert into a hole in the weight increment rod to interconnect one or more weights to the weight increment rod 74 (FIG. 3) attached to the lift plate 60.

To assist in the smooth vertical travel of the weights along the guide rods, guide bushings (not shown) may be provided in the apertures of the guide bar openings of the weights. In addition, the guide bushings can act as spacer members between weights.

Figure 3A:
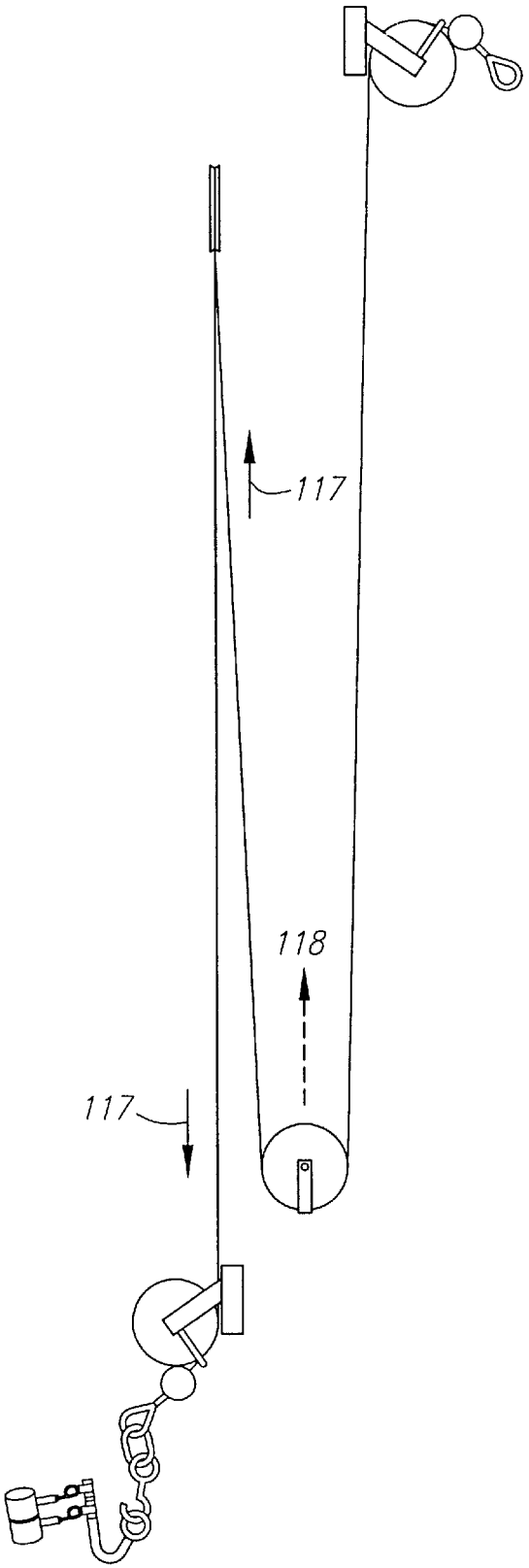
FIGS. 3A and 3B illustrate the arrangement of the pulleys and movement of the cable when force is exerted on the cable.
Figure 3B:
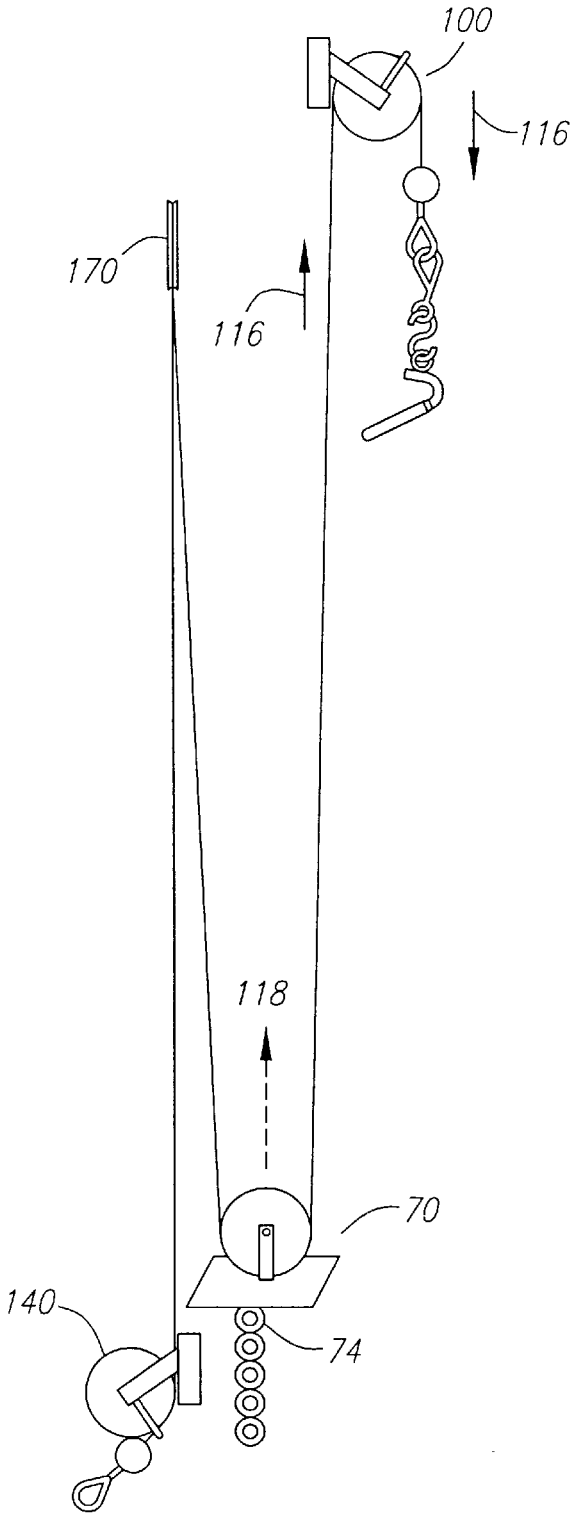

A pulley system guides the cable from the lift plate to various locations of the exercise machine. The pulley system preferably consists of four pulley assemblies: a lower swivel pulley assembly 140 on a lower telescoping adjustment arm 134, an upper pulley assembly 170, a lift plate pulley assembly 70, and an upper swivel pulley assembly 100 on an upper telescoping adjustment arm 82. FIGS. 3A and 3B illustrate the arrangement of the pulleys and movement of the cable depending on the location from which the cable is drawn by the user. The cable is threaded under the lower swivel pulley, up to and over the upper stationary pulley from front to back, down and under the lift plate pulley from back to front and up and over the upper swivel pulley from back to front. Solid arrows 116 denote movement of the cable when the cable is drawn from the upper swivel pulley, while solid arrows 117 denote movement of the cable when the cable is drawn from the lower swivel pulley. Force exerted on the cable from either direction results in movement of the lift plate, weight increment rod, and selected weights in the direction of arrow 118.

Figure 4:
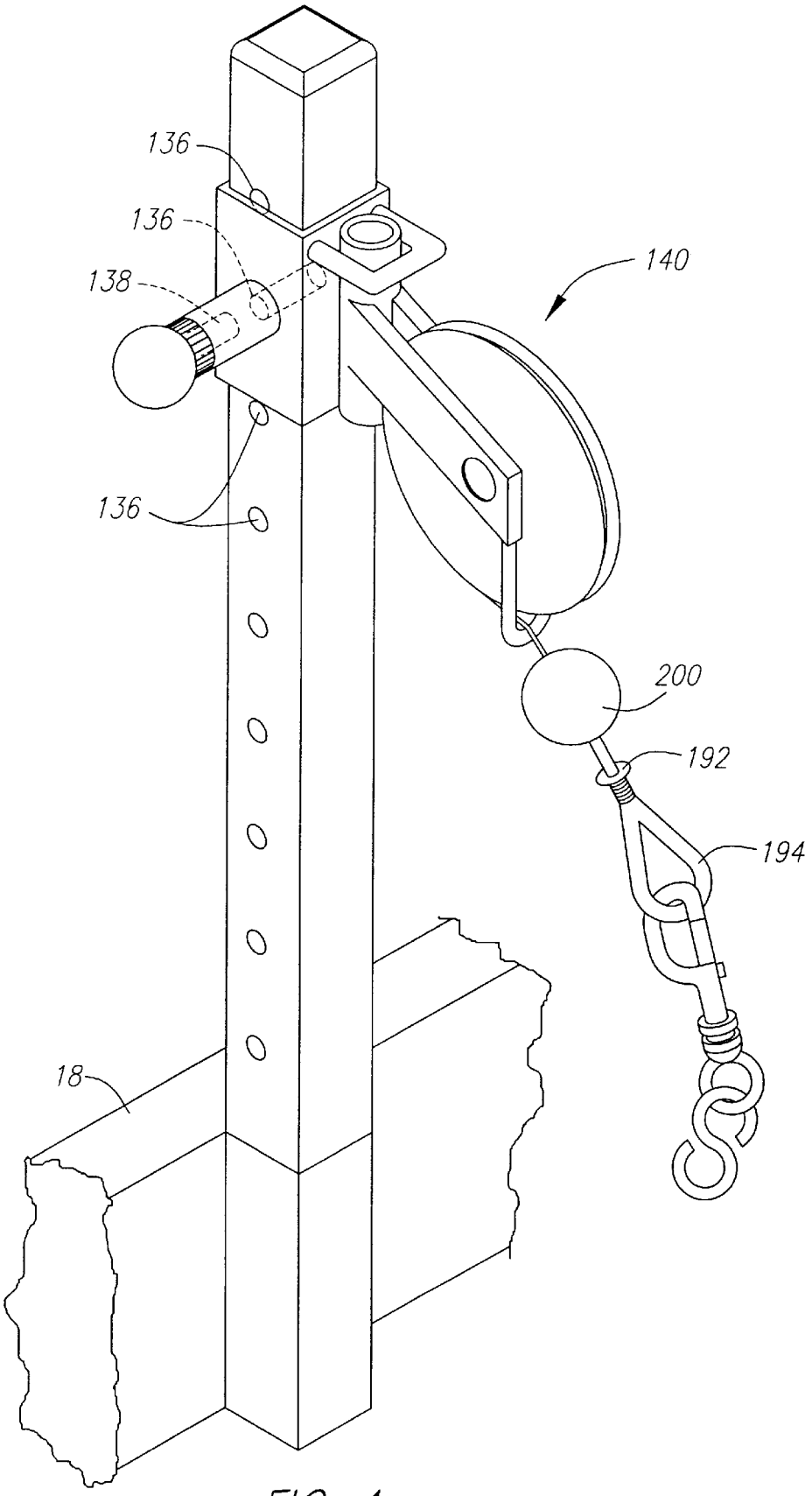
FIG. 4 illustrates the arrangement of a lower swivel pulley on the lower adjustment arm.

The lower swivel pulley assembly 140 is mounted on an adjustment arm bracket which is slideably connected to a vertically extending lower telescoping adjustment arm 134 which is rigidly attached to the front face of the lower cross bar of the frame. FIG. 4 illustrate details of a preferred lower swivel pulley assembly mounted to the lower adjustment arm. The lower adjustment arm 134 has a plurality of holes 136 placed at intervals along the length of the arm, which can receive one or more lock pins 138 (shown in phantom). A pin housing 90 is rigidly attached to the adjustment arm bracket. The pin housing 90 contains a locking pin 86 and a spring 92. The locking pin 86 extends through the housing and bracket and can be inserted into one of the plurality of holes 136 in the adjustment arm. A handle is fastened onto the pin to permit the user to easily withdraw the pin 86 from the hole in order to move the lower adjustment arm bracket and lower swivel pulley assembly vertically relative to the lower adjustment arm.

An upper pulley assembly 170 is mounted on the upper surface of the upper cross member 16 of the frame. Two upper pulley connector tabs 172 are rigidly attached to the top of the frame orthogonal to the upper surface of the upper cross member. The upper pulley 180 is rotatably mounted between the two connector tabs. Cable guide brackets 71 are mounted to the upper pulley connector tabs.

Figure 5:
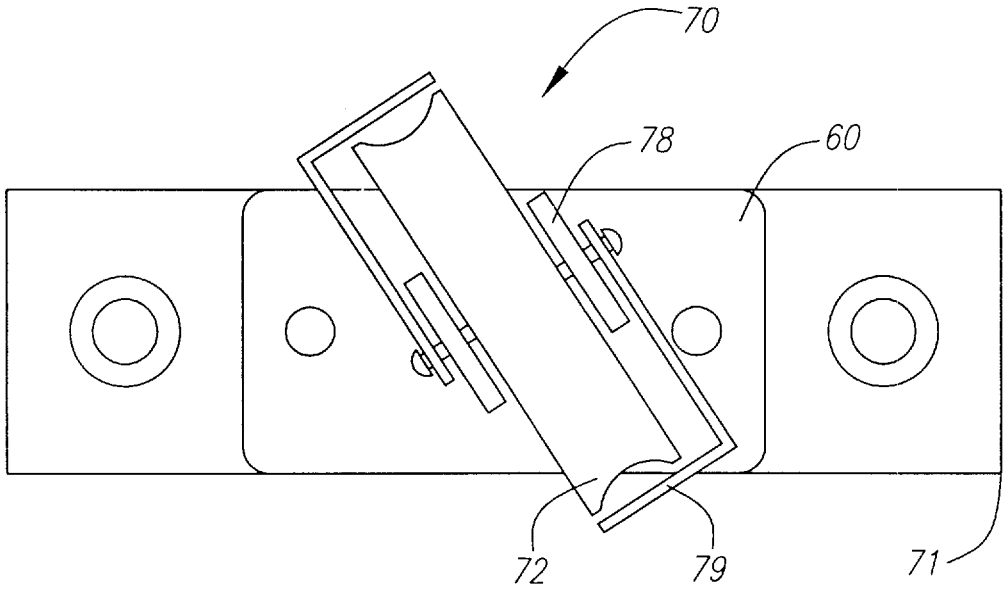
FIG. 5 shows a cross-sectional view of the machine view along line 5—5 in FIG. 2 from above the lift plate illustrating details of the lift plate pulley assembly 70.

A lift plate pulley assembly 70 is mounted on the upper side of the lift plate. FIG. 5 shows a cross-sectional view of the machine view along line 5—5 in FIG. 2 from above the lift plate illustrating details of the lift plate pulley assembly 70. The lift plate pulley 72 is rotatably mounted between two lift plate pulley connector tabs 78 attached to the lift plate 60 at an angle partially orthogonal to the longitudinal axis of the lift plate, preferably a 30° angle. Cable guide brackets 71 are mounted to the lift plate pulley connector tabs.

Figure 6:
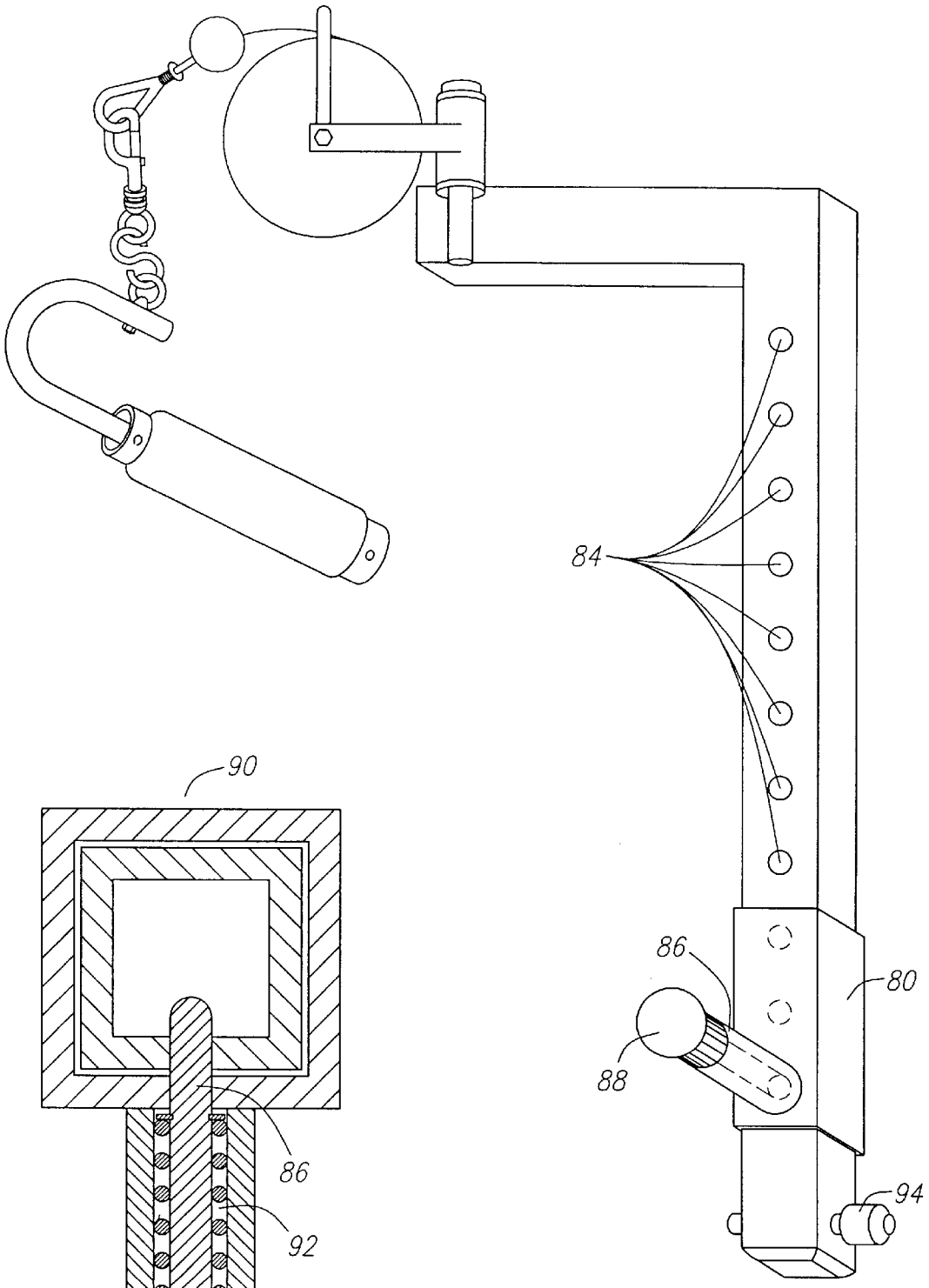
FIG. 6 illustrates the arrangement of the upper swivel pulley on the upper adjustment arm.
Figure 7:
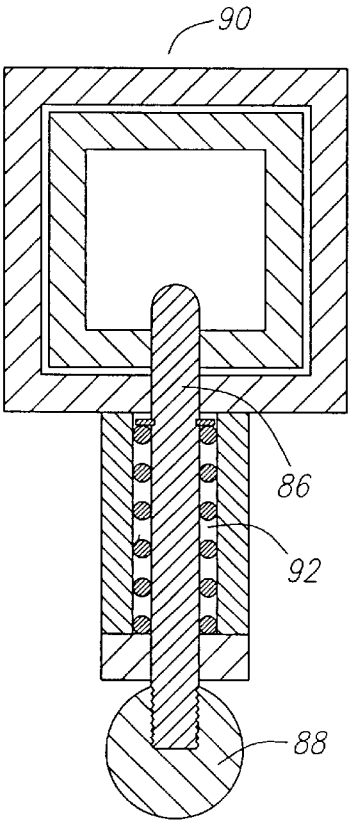
FIG. 7 is a cross sectional view of the upper adjustment arm bracket along the line 7—7 in FIG. 6.

A vertically extending upper adjustment arm 82 acts as a support prop for the upper swivel pulley assembly 100. The arrangement of the upper swivel pulley assembly on the upper adjustment arm is shown in FIG. 6. The upper adjustment arm is preferably shaped like an inverted L, with the base of the L extending horizontally toward the center of the machine, and the stem of the L inserted into an upper adjustment arm bracket 80 rigidly attached to an upright beam of the frame. The height of the upper swivel pulley assembly can be adjusted by changing the height of the upper adjustment arm with respect to the bracket. Locking pins 86 are used to lock the upper adjustment arm at the desired height with respect to the upper adjustment arm bracket 80. A pin housing 90 is rigidly attached to the adjustment arm bracket. FIG. 7 shows a cross-sectional view of the pin housing. The pin housing 90 contains a locking pin 86 and a spring 92. The locking pin 86 extends through the housing and bracket and can be inserted into one of the plurality of holes 84 in the adjustment arm. A handle is fastened onto the pin to permit the user to easily withdraw the pin 86 from the hole in order to move the upper adjustment arm vertically relative to the upper adjustment arm bracket. The pin 86 can be inserted into a different hole to alter the height of the adjustment arm and attached swivel pulley assembly.

A retaining peg 94 is mounted near the lower end of the upper adjustment arm to prevent accidently sliding adjustment arm from the bracket during height adjustment.

The cable is preferably made of coated wire rope, and both ends of the cable preferably are formed into standard loops 194 shown in FIG. 4. A cable retainer 200 is fixably attached near each of the cable in order to prevent the end of the cable from retracting past the lower and upper swivel pulleys, and a washer 192 is slideably mounted on the cable proximate to the standard loop.

A body engaging assembly 210 is detachably fastened to one end of the cable for engagement by the body of a person using the machine. Standard fasteners such as spring clips and S links may be used to fasten the body engaging member to the standard loop at the end of the cable. The cable retainer 200 on the lower end of the cable prevents the end of the cable from moving past the lower swivel pulley when force is exerted on a body engaging assembly connected to the upper end of the cable. The cable retainer on the upper end of the cable prevents the upper end of the cable from moving past the upper swivel pulley when force is exerted on a body engaging assembly connected to the lower end of the cable.

The body engaging assemblies of this invention contain a three-dimensional tubular rod 212 in which the path of the tubing lies in more than one plane. The body engaging assemblies may be constructed from one or more pieces of tubing. Preferably, the body engaging assemblies are formed by bending a single piece of tubing into the correct shape, but the body engaging assemblies may also be formed by fixably attaching pieces of tubing corresponding to different regions of a body engaging assembly in order to form a unitary body engaging assembly having the proper shape. When engaged by a part of the body, the body engaging assemblies permit smooth, unrestricted, natural movements of the engaged body part. These movements can encompass the full range of motion permitted by the joints and musculature of the user. Exercises performed using the body engaging assemblies of this invention avoid isolating a single muscle group which could disrupt a smooth motion and restrict movement. The body engaging assemblies contain a body engaging member and a cable connector 250 in order to connect the user with the cable drawn resistance source.

Figure 8A:
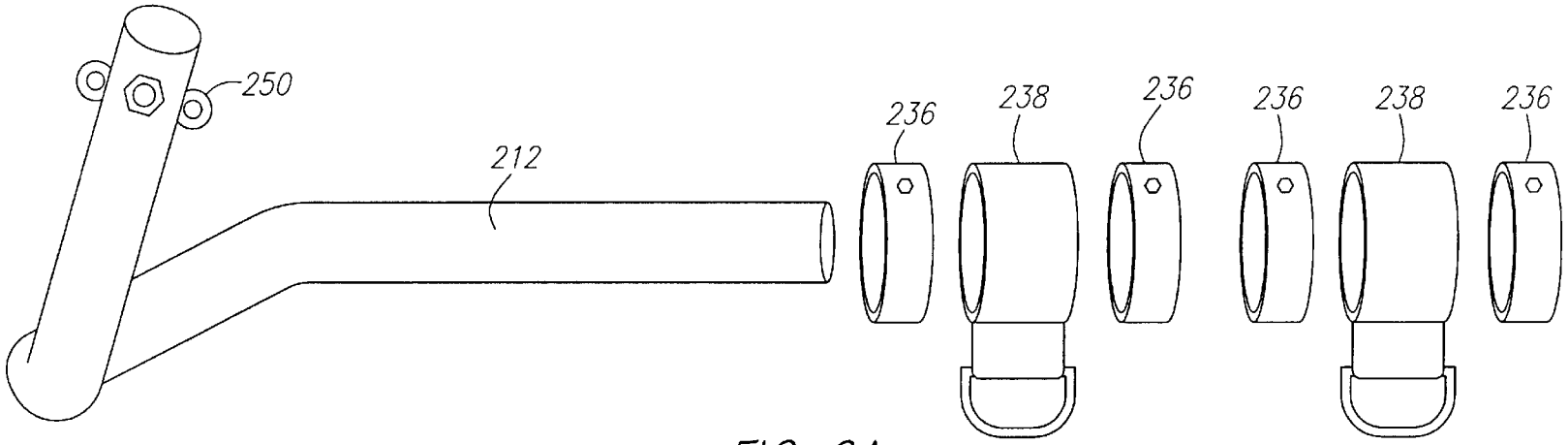
FIG. 8A is an exploded view of a body engaging device when the device will be engaged by a part of the body other than the user's hand.

The body engaging member is preferably rotatable about the longitudinal axis of the segment of the body engaging assembly to which it is attached. For example, where the engagement is with the user's hand, the body engaging portion of the body engaging assembly preferably contains a sleeve 214 which the user grips to engage the body engaging assembly. The sleeve is rotatable about the longitudinal axis of that segment of the body engaging assembly. Preferably the sleeve is made of polyvinylchloride tubing. The sleeve may preferably be covered with a pad to provide comfort to the user. Retaining rings 216 may be used to rotatably mount the sleeve onto the tubular rod. FIG. 8 is an exploded view of a hand engaging device showing the arrangement of the retaining rings 216 and the sleeve 214.

Where the user does not engage the body engaging assembly with a hand, the body engaging member is preferably a cuff or strap or set of cuffs or straps 230 which is rotatable about the longitudinal axis of the segment of the tubular rod of the body engaging assembly to which it is attached. The body engaging assembly may strap onto various parts of the user's body, including the user's ankle, knee, wrist or elbow, preferably the user's foot and ankle. The straps have a closing mechanism, preferably velcro, which permits adjustment to accommodate body parts of various sizes. The straps or cuffs may preferably be padded to provide comfort to the user. Preferably the body engaging assembly is a set of padded nylon straps.

The body engaging assembly may attach directly to the tubular member, for example, by forming a longitudinal bore from loops of cloth attached to the straps. The tubular rod of the body engaging assembly can be inserted through the longitudinal bore of the loops of cloth, and the body engaging assembly can be secured on the tubular member with retaining rings 236, which permit the loops to rotate about the longitudinal axis of the segment of the tubular member to which it is attached.

In addition, the body engaging assembly may contain fasteners which permit the detachment of the strap portion of the body engaging member from the loop portion of the body engaging member which is mounted onto the tubular rod. For instance, loops of cloth 238 independent of the straps 230 of the body engaging member can be rotatably mounted on the tubular rod by inserting the tubular rod through the longitudinal bore of the loops of cloth. These loops of cloth contain a connector, for example a D-ring 234 or O-ring (not shown) which can be used to connect the loops of cloth and attached tubular rod to the straps or cuffs of the body engaging member. In one preferred embodiment the body engaging member contains a set of padded velcro closing ankle and foot straps 230 with spring clips 232. These spring clips can be detachably connected to the D rings 234 attached to the loops of cloth. Even when the strap portion of the body engaging member to the tubular rod is connected to the loop portion by detachable fasteners, the body engaging member will be rotatable about the longitudinal axis of the segment to which it is detachably connected. Use of a detachable connection between the set of straps and the tubular member permits laundering and facilitates ease of replacement or repair of the straps.

The tubular rods of the body engaging assemblies have asymmetric three-dimensional shapes. By asymmetric is meant that there is no plane of symmetry in the shape of the tubular rod. In one preferred embodiment these asymmetric shapes preferably roughly resemble a three-dimensional J-shape having a stem and a loop in which the portion of the tubular rod corresponding to the end of the loop of the J distal from the stem lies in a plane partially orthogonal to the plane in which the stem and the adjacent portion of the loop lie. In this embodiment, the end of the tubular rod corresponding to the stem of the J is the segment of the rod to which the body engaging member is attached, while the end of the loop of the "J" distal from the stem contains the cable connector, preferably an eye bolt 250. In a more preferred embodiment, the tubular rod of the body engaging assembly has an angulated three dimensional J-shape, in which linear segments of the tubular rod form a three-dimensional J shape. In the most preferred embodiments, the tubular rod has four segments which form an angulated three dimensional J-shape.

Tables 1–4 provide Cartesian coordinates (X,Y,Z), and the angles between segments in the most preferred embodiments of the three-dimensional tubular rods. The segments of the tubular rods of the body engaging assemblies of this invention will preferably have angles between segments which are substantially similar to the angles specified below. By substantially similar angle is preferably meant +/−20°, more preferably +/−10°, and even more preferably +/−5°. In addition, the lengths of the segments in these embodiments will be substantially similar to the lengths specified below. By substantially similar length is meant +/−2 inches, more preferably +/−1 inch. Furthermore, one of ordinary skill in the art can calculate the angles between planes defined by any three points based on the Cartesian coordinates. Other preferred embodiments will have Cartesian coordinates of about the specified coordinates. By "of about" is meant preferably +/−25%, more preferably +/−10% and most preferably +/−5%.

These embodiments include body engaging assemblies to engage the right hand, the left hand, the right foot, and the left foot. Although these embodiments are referred to as specifically engaging either the right or left appendage, the right hand engaging assembly and the left hand engaging assembly are mirror images of one another and may be interchanged for use in actuating an exercise machine. In addition, the tubular portions of the right foot engaging assembly and the left foot engaging assembly are mirror images of one another and may be interchanged.

Figure 8B:
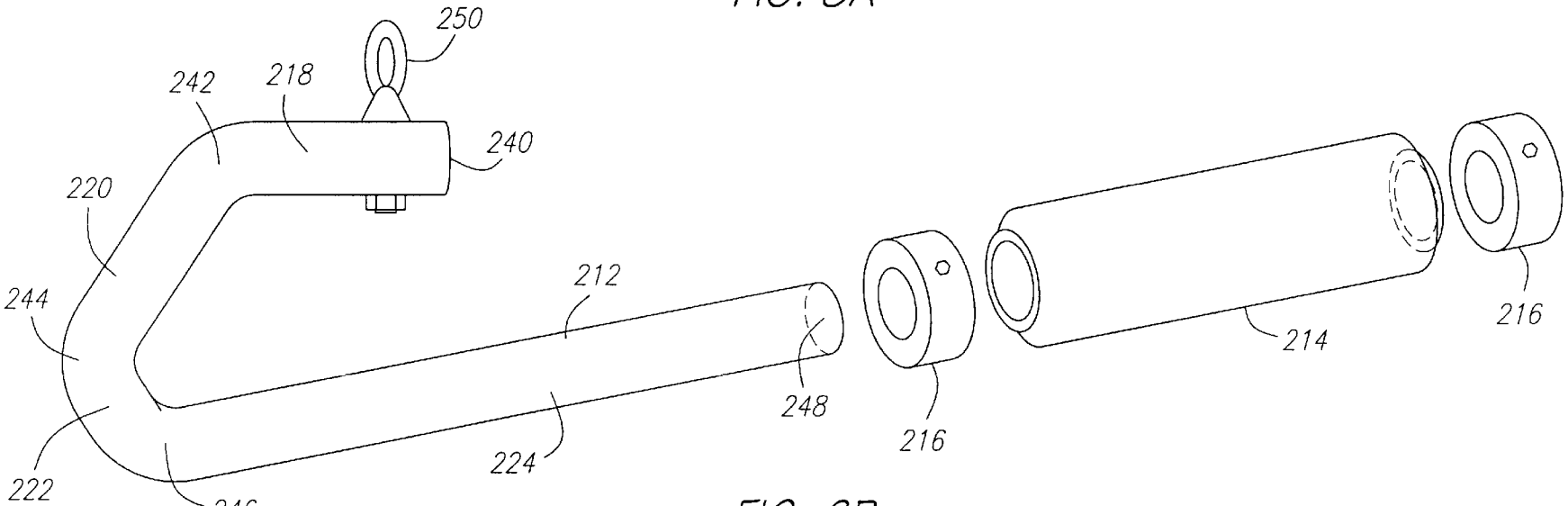
FIG. 8B is an exploded view of a body engaging assembly to be engaged by the user's hand.
Figure 9A:
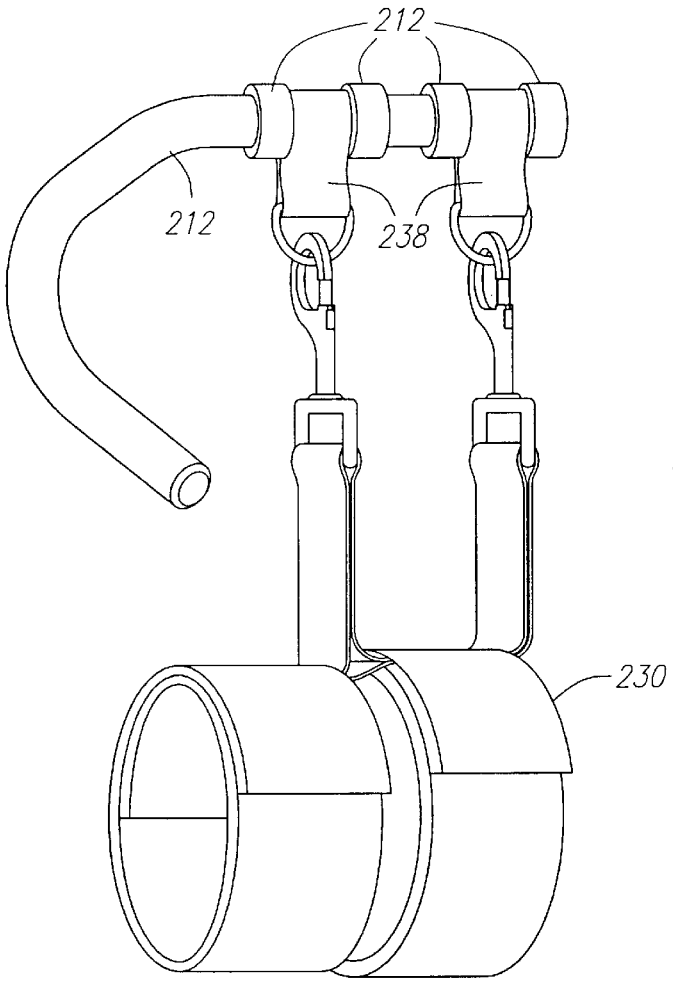
FIG. 9A shows a front view of the left foot engaging assembly.
Figure 9B:
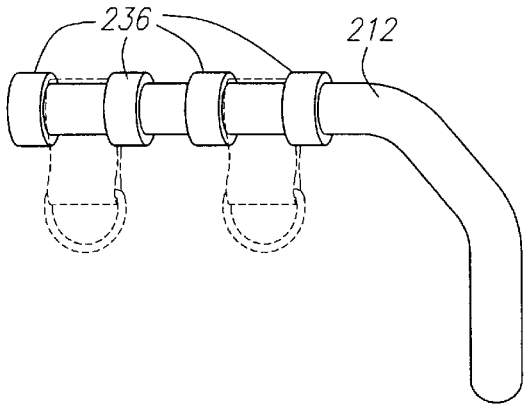
FIG. 9B shows a rear view of the left foot engaging assembly with the strap portion of the left foot engaging member detached and the fabric loops and D rings shown in phantom.
Figure 9C:
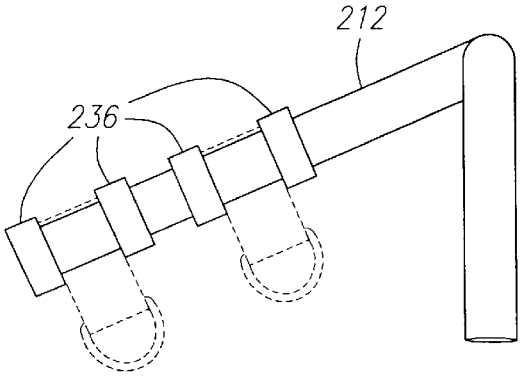
FIG. 9C shows a bottom view of the left foot engaging assembly as in FIG. 9B.
Figure 9D:
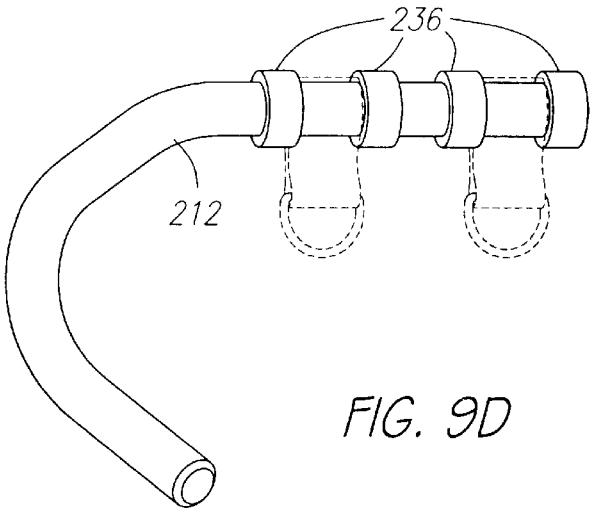
FIG. 9D shows the same view as the view in FIG. 9A, except that the strap portion of the body engaging member detached and the fabric loops and D rings shown in phantom.
Figure 9E:
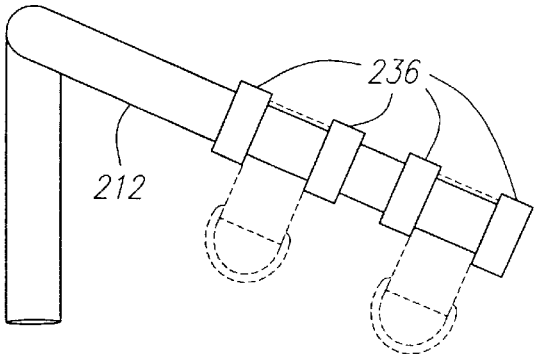
FIG. 9E shows a top view of the left foot engaging assembly as in FIG. 9D.
Figure 9G:
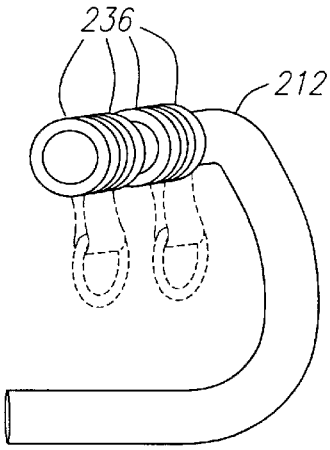
FIG. 9G shows the right side view of the left foot engaging assembly as in FIG. 9D.
Figure 9F:
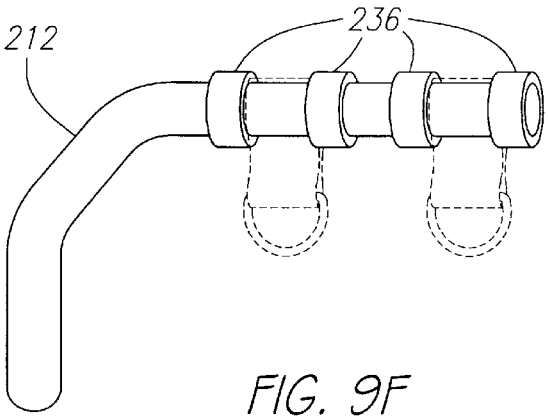
FIG. 9F shows a another perspective of the front of the left foot engaging assembly, where the perspective is to the right of the perspective in FIG. 9D.
Figure 9H:
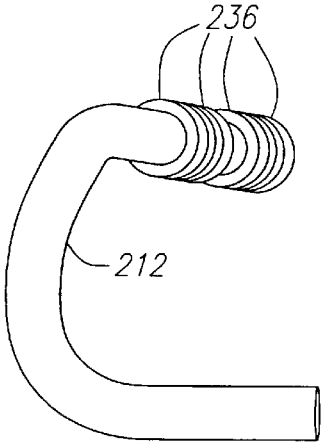
FIG. 9H shows the right side view of the left foot engaging assembly as in FIG. 9D, without the fabric loops. Elements common to those shown in FIGS. 1–8 have been like numbered.
Figure 10:
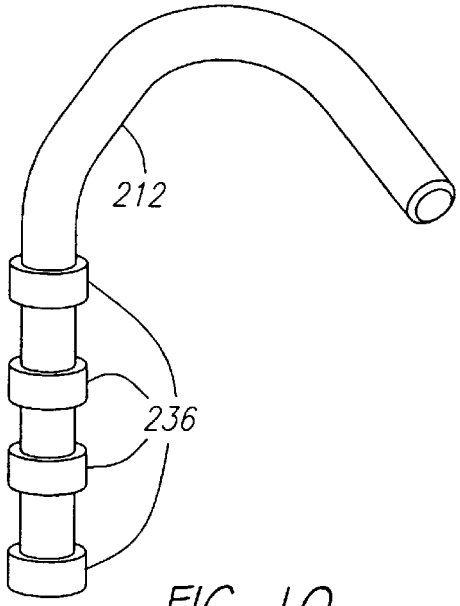
FIG. 10 shows a front view of a right foot engaging assembly without the fabric loops and straps attached.

In the Cartesian coordinate data, points 1–5 refer to the points at the end of each segment, along the longitudinal axis of the tubular rod. As illustrated in FIG. 8B, Point 1 240 corresponds to the point at one end of the rod, point 2 242 is the point at the intersection of segment 1 218 and segment 2 220, point 3 244 is the point at the intersection of segment 2 220 and segment 3 222, point 4 246 is the point at the intersection of segment 3 222 and segment 4 224, and point 5 248 is the point at the end of segment 4 which is distal from segment 4, which is also the point at the second end of the rod.

TABLE 1A

CARTESIAN COORDINATES FOR TUBULAR MEMBER OF RIGHT HAND ENGAGING ASSEMBLY

| POINT NO. | X | Y | Z |
|---|---|---|---|
| 1 | 0.000 | 0.000 | 0.000 |
| 2 | 0.000 | 2.056 | 0.000 |
| 3 | 2.376 | 3.912 | 0.000 |
| 4 | 3.458 | 4.421 | −2.802 |
| 5 | 3.638 | −1.588 | −8.106 |

TABLE 1B

| SEGMENTS | ANGLE |
|---|---|
| 1–2 | 127.99° |
| 2–3 | 113.49° |
| 3–3 | 119.43° |

TABLE 2A

CARTESIAN COORDINATES FOR TUBULAR MEMBER OF LEFT HAND ENGAGING ASSEMBLY

| POINT NO. | X | Y | Z |
|---|---|---|---|
| 1 | 0.000 | 0.000 | 0.000 |
| 2 | 0.000 | 2.056 | 0.000 |
| 3 | −2.376 | 3.912 | 0.000 |
| 4 | −3.458 | 4.421 | −2.802 |
| 5 | −3.638 | −1.588 | −8.106 |

TABLE 2B

| SEGMENTS | ANGLE |
|---|---|
| 1–2 | 127.99° |
| 2–3 | 113.49° |
| 3–4 | 119.43° |

TABLE 3A

CARTESIAN COORDINATES FOR TUBULAR MEMBER OF RIGHT FOOT ENGAGING ASSEMBLY

| POINT NO. | X | Y | Z |
|---|---|---|---|
| 1 | 0.000 | 0.000 | 0.000 |
| 2 | 0.000 | 6.060 | 0.000 |
| 3 | 1.676 | 7.622 | 0.000 |
| 4 | 4.106 | 7.533 | 0.150 |
| 5 | 3.745 | 5.968 | 3.864 |

TABLE 3B

| SEGMENTS | ANGLE |
|---|---|
| 1–2 | 132.99° |
| 2–3 | 134.79° |
| 3–4 | 88.95° |

TABLE 4A

CARTESIAN COORDINATES FOR TUBULAR MEMBER OF LEFT FOOT ENGAGING ASSEMBLY

| POINT | X | Y | Z |
|---|---|---|---|
| 1 | 0.000 | 0.000 | 0.000 |
| 2 | 0.000 | 6.060 | 0.000 |
| 3 | −1.676 | 7.622 | 0.000 |
| 4 | −4.106 | 7.533 | 0.150 |
| 5 | −3.745 | 5.968 | 3.864 |

TABLE 4B

| SEGMENTS | ANGLE |
|---|---|
| 1–2 | 132.99° |
| 2–3 | 134.79 |
| 3–4 | 88.95° |

A second preferred embodiment of the body engaging assembly having a three-dimensional tubular member is a body engaging assembly suitable for exercises performed while grasping the body engaging assembly with both hands. In this embodiment, the three-dimensional body engaging assembly has two body engaging members 260, with each one rotatably attached to one end portion of the tubular rod 262. Each body engaging assembly preferably rotates about the longitudinal axis of the portion of the tubular member to which it is attached. In more preferred embodiments, the tubular rod is bent into segments.

More preferably, the tubular rod of this body engaging assembly contains four segments including two end segments and two central segments. The angle between the two central segments is an acute angle, while the angles between the end segments and the adjacent segments are obtuse angles. In this embodiment, the body engaging members are sleeves 260 rotatably mounted on the end segments

TABLE 5

CARTESIAN COORDINATES FOR TUBULAR MEMBER OF TWO HAND ENGAGING ASSEMBLY

| POINT | X | Y | Z |
|---|---|---|---|
| 1 | 0.0 | 0.0 | 0.0 |
| 2 | 5.5 | 5.5 | 0.0 |
| 3 | 9.0 | 4.0 | 9.0 |
| 4 | 12.5 | 5.5 | 0.0 |
| 5 | 18.0 | 0.0 | 0.0 |

Figure 13A:
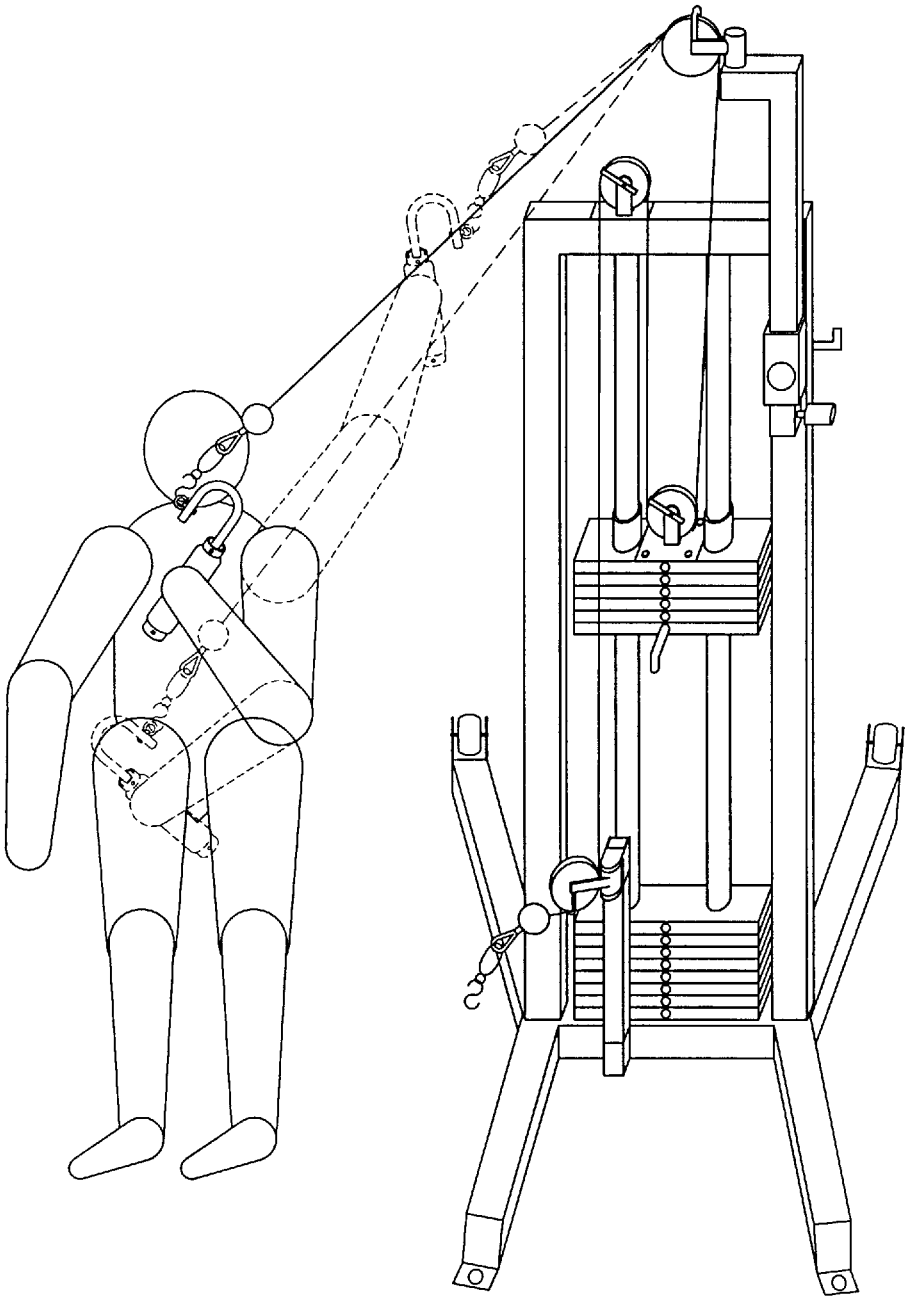
Figure 13B:
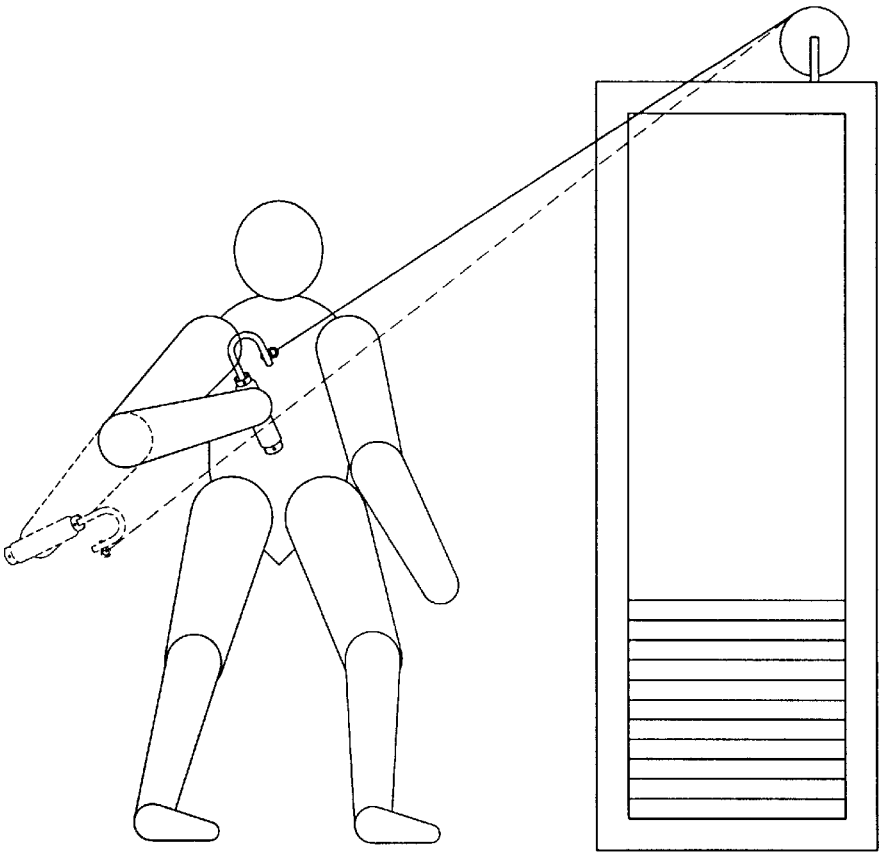
Figure 13C:
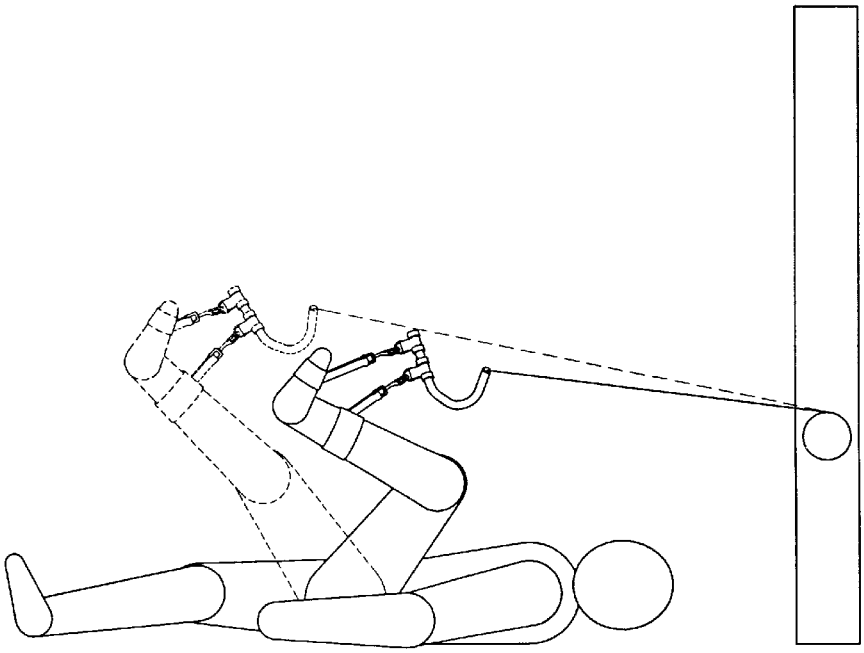
Figure 13D:
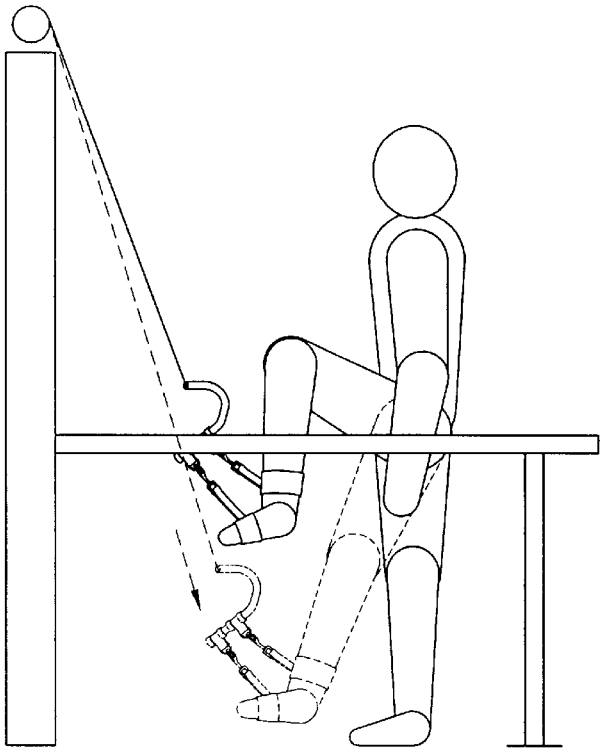
Figure 13E:
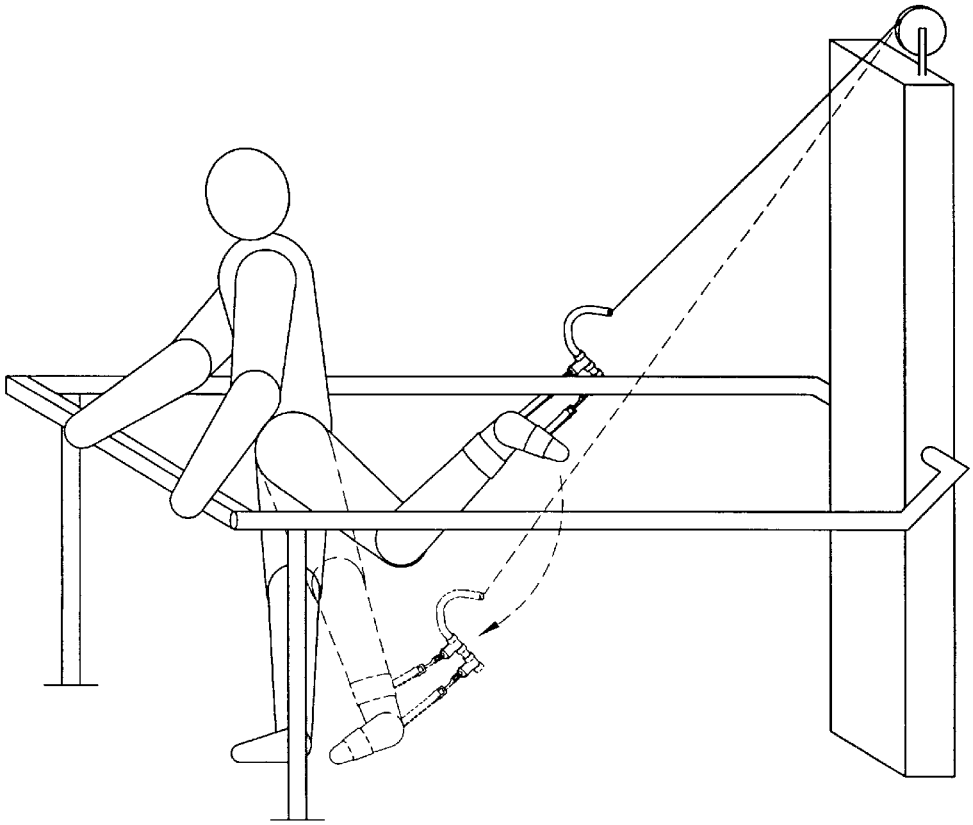
Figure 13F:
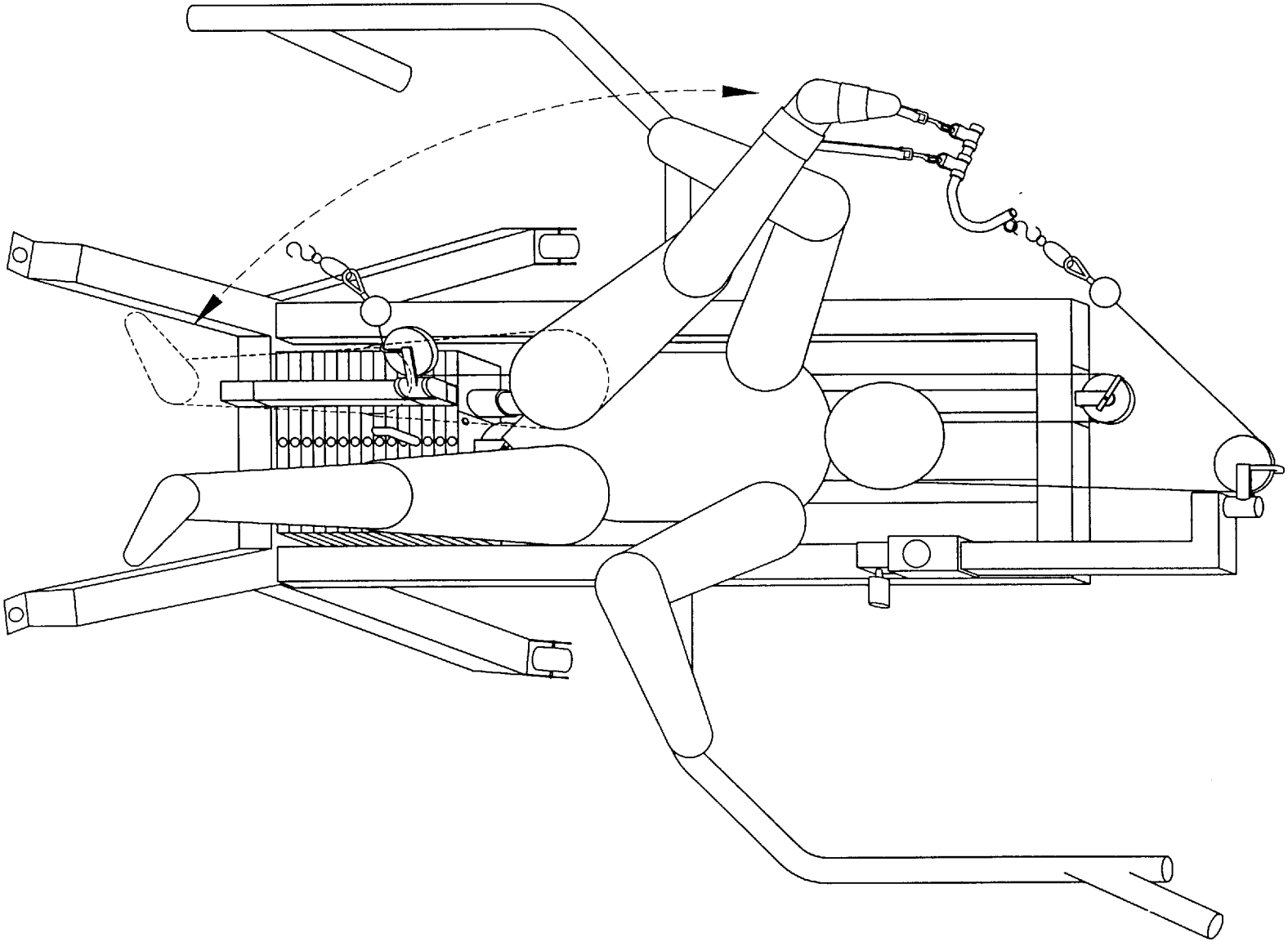
Figure 13G:
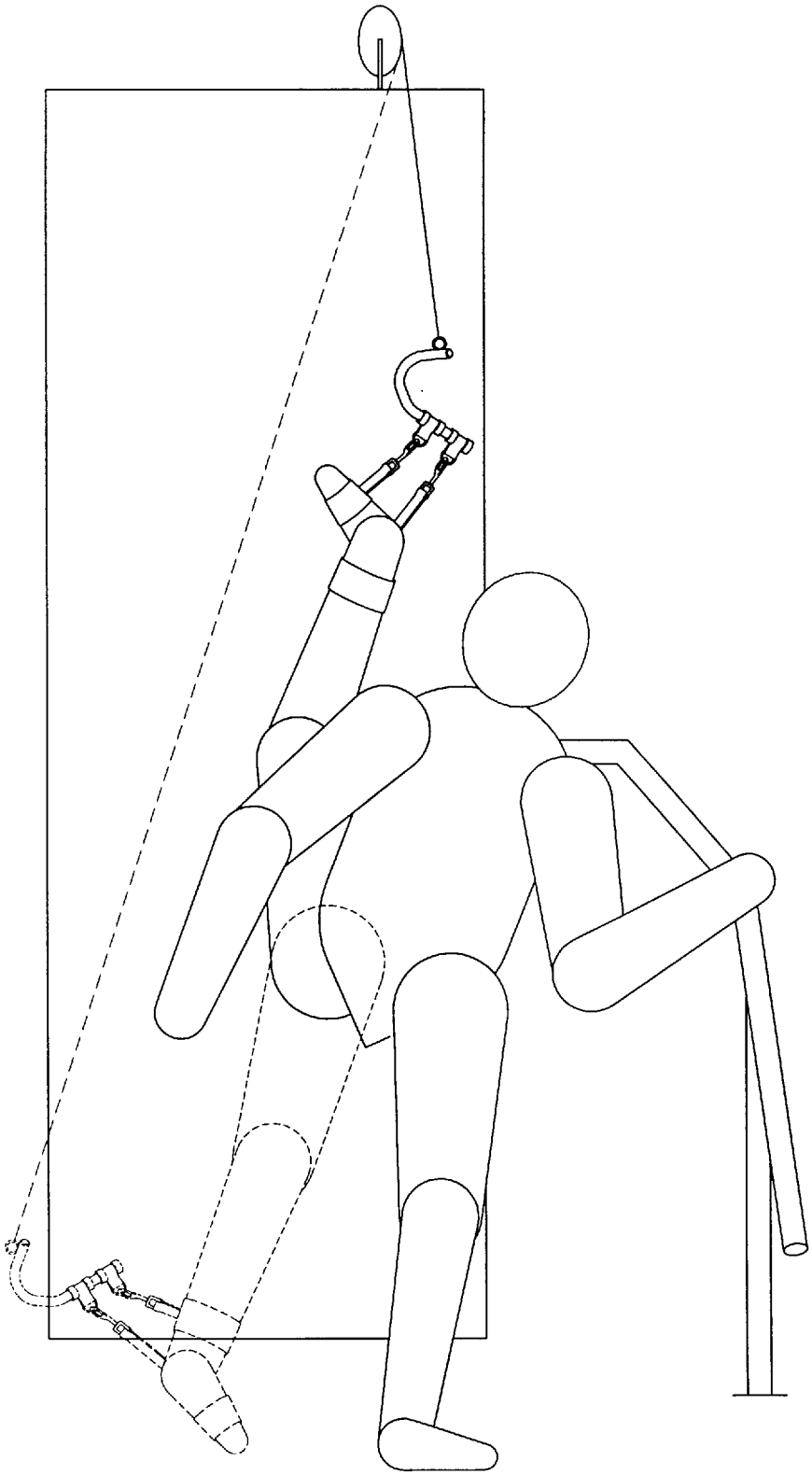
Figure 13H:
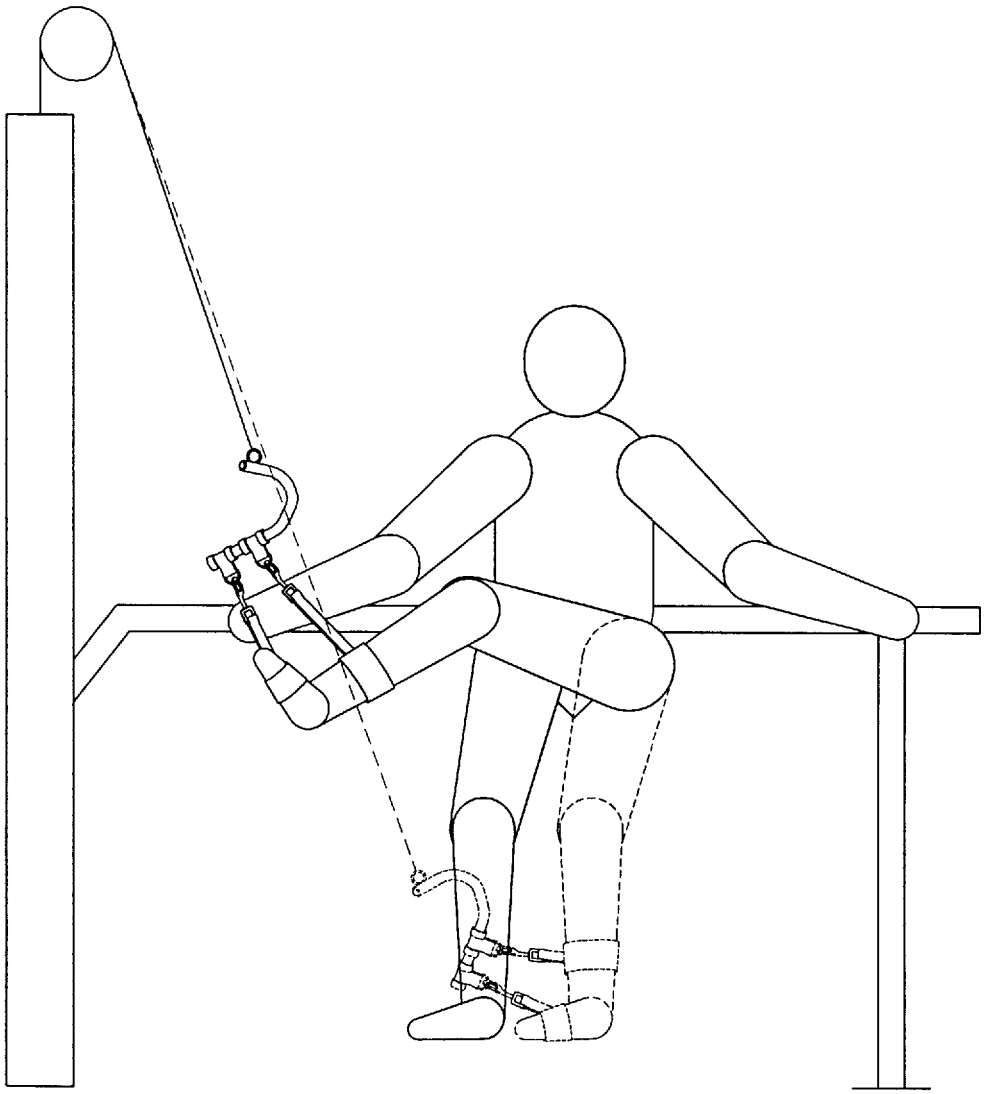
Figure 131:
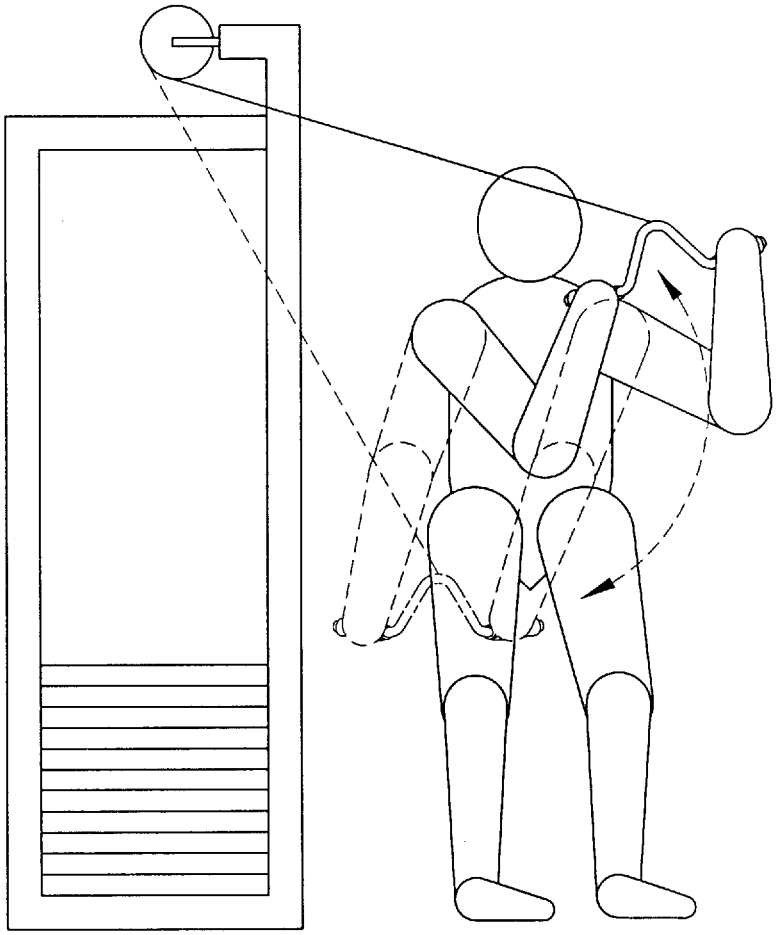
Figure 13J:
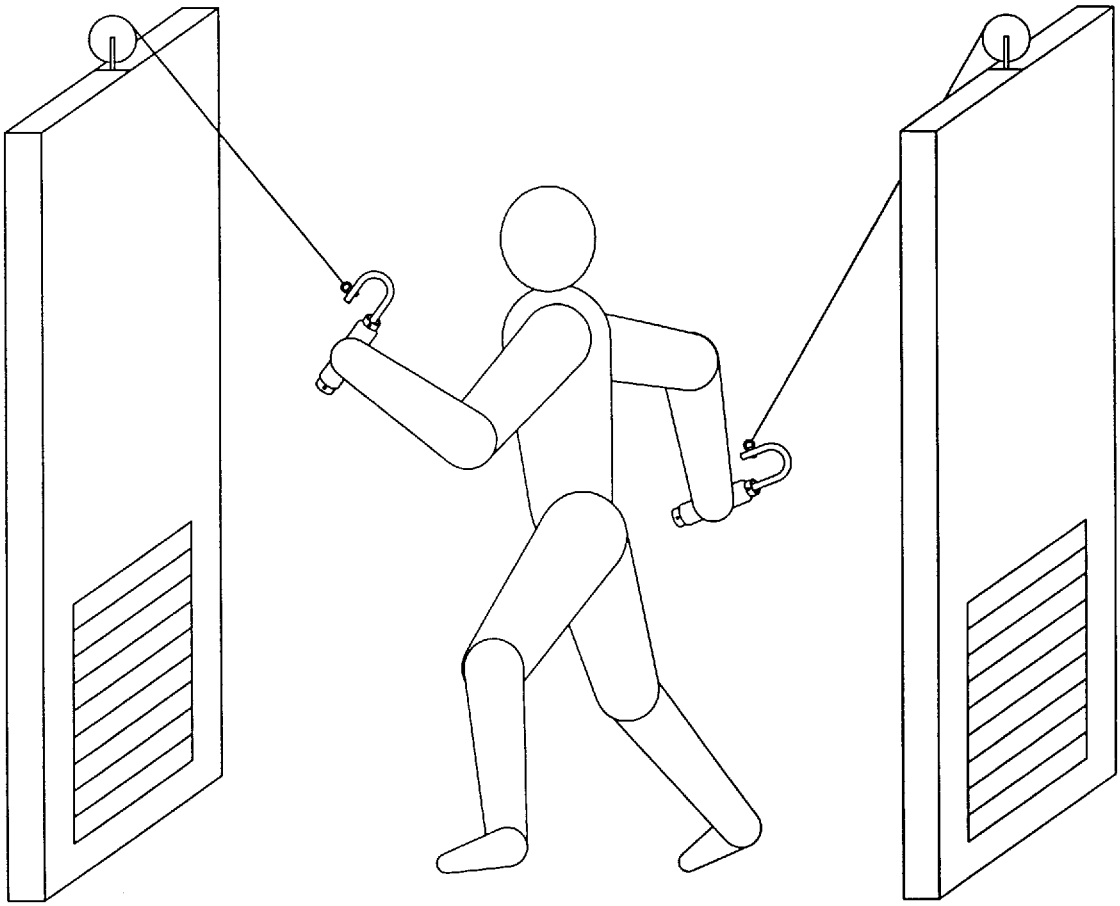

FIGS. 13A–J illustrate various exercises which may be performed using the exercise machine in combination with the body engaging assemblies of this invention. In these figures, details of the weight machine have been omitted to focus on the image of the user of the exercise machine. Positions after movements are shown in phantom. Because these weight machines allow full range of motion movements, these figures are not intended to illustrate all the possible exercises which can be performed using the machine. FIG. 13A depicts an exercise motion performed while standing upright and gripping a hand engaging assembly drawn from the upper swivel pulley. The movement begins with the arm raised overhead slightly to the side of the body. The exerciser then moves the arm diagonally across the body, and then returns to the starting position. FIG. 13B depicts an exercise motion performed while standing upright and gripping a hand engaging assembly drawn from the upper swivel pulley. The movement begins with the arm raised across the body. The exerciser then draws the cable down and back across the body, before returning the rest position. FIG. 13C depicts an exercise performed while lying on the back on the floor while engaging a foot engaging assembly which straps around the foot and ankle. The cable is drawn from the lower swivel pulley. The movement begins with the leg bent and drawn upward toward the chest. The exerciser then straightens the leg, before returning to the initial position. FIG. 13D illustrates an exercise performed while standing upright while engaging a foot engaging assembly. The movement begins with the knee raised. The exerciser then straightens the knee, bringing the leg down, before returning to the initial position. FIG. 13E shows an exercise performed while standing upright while engaging a foot engaging assembly, with the hands on the front rail to help balance during the movement. The movement begins with the leg bent back and upward. The exerciser then brings the leg downward, before returning to the initial position. FIG. 13F depicts an exercise performed while standing upright while engaging a foot engaging assembly, with the hands on the handrails to help balance during the movement. The movement begins with the leg extended overhead. The exerciser then brings the leg downward, before returning to the initial position. This figure also depicts another arrangement of the handrails, with one handrail positioned horizontal to the floor, while the other handrail rests against the wall. FIG. 13G depicts an exercise performed while standing upright while engaging a foot engaging assembly, with a hand on a handrail to help balance during the movement. The movement begins with the upper body leaning forward and the leg extended up and back behind the body. The user then moves the leg down and forward, before returning to the initial position. FIG. 13H depicts an exercise performed while standing upright while engaging a foot engaging assembly, with a hand on a handrail to help balance during the movement. The movement begins with the leg raised and the knee bent. The leg is then lowered, while keeping the knee slightly bent, before returning the initial position. FIG. 13I depicts an exercise performed while standing upright while engaging a two handed engaging assembly. The movement begins with both hands overhead on the engaging assembly. The exerciser then brings both hands across the body, before returning to the initial position. FIG. 13J depicts the use of two exercise machines while standing upright and engaging a hand engaging assembly in each hand drawn from the upper swivel pulley of each machine. The exercise machines are positioned facing one another. Various movements can be performed in this position.

While embodiments and applications of this invention have been shown and described, it should be apparent to those of ordinary skill in the art that the these examples are merely illustrative, and that many embodiments are possible without departing from the spirit and scope of the subject invention. Accordingly, the invention is not to be restricted, except as by the appended claims.

What is claimed is:

1. An exercise apparatus, comprising:

a frame;

a weight adapted to move relative to said frame;

a cable movably mounted to said frame, wherein the cable has a first end coupled to the weight and a second end; and a body engaging assembly, including a) an asymmetrically shaped tubular rod having two end portions, wherein each portion of the rod has a longitudinal axis;

b) a body engaging member having a longitudinal bore rotatably mounted on the first end portion of the tubular rod, wherein the body engaging member is rotatable about the longitudinal axis of the first end portion of the tubular rod; and c) a cable connector fixably mounted to the second end portion of the tubular rod, wherein the cable connector is attached to the second end of the cable;

wherein the asymmetrically shaped tubular rod is an angulated non-planar J-shaped tubular rod having a first end portion forming the stem of the J, and at least three segments forming the loop of the J, wherein the second end portion of the rod forms the last segment of the loop of the J and wherein the second end portion and the adjacent segment lie in a plane, and wherein the first end portion and the first segment lie in a plane at an angle to the plane in which the second end portion and the adjacent segment lie.

2. The exercise apparatus of claim 1, further comprising detachable and adjustable handrails pivotably mounted to said frame, wherein the handrails can be independently adjusted to at least one position parallel to the ground wherein the handrails provide support while performing full range of motion exercises in a standing position; and wherein the handrails can be independently adjusted to a second position wherein the handrails are displaced from the exercise floor space.

3. The exercise apparatus of claim 1, further comprising:

(d) a lift plate adapted to move relative to the frame with the weight; and (e) a guided cable pulley system comprising four pulley assemblies wherein three pulley assemblies are attached to the frame and at least two of the three pulley assemblies attached to the frame have multiple attachment points on the frame, wherein the height of the at least two pulley assemblies can be adjusted relative to the frame; and wherein the fourth pulley assembly is fixably mounted on the lift plate.

4. A method of exercise comprising the steps of:

a) engaging a body engaging assembly comprising an asymmetrical three-dimensional tubular rod having two end portions, wherein each portion of the rod has a longitudinal axis; a body engaging member having a longitudinal bore which telescopically receives the first end portion of the tubular rod, wherein the body engaging member is rotatable about the longitudinal axis of the first said end portion of the tubular rod; and a cable connector attached to the second end of the tubular rod;

wherein the asymmetrically shaped tubular rod is an angulated non-planar J-shaped tubular rod having a first end portion forming the stem of the J, and at least three segments forming the loop of the J, wherein the second end portion of the rod forms the last segment of the loop of the J and wherein the second end portion and the adjacent segment lie in a plane, and wherein the first end portion and the first segment lie in a plane at an angle to the plane in which the second end portion and the adjacent segment lie; and b) performing smooth, unrestricted natural movements against a variable resistance source.

5. A body engaging assembly for actuating a cable-drawn, exercise device, comprising:

an asymmetrically shaped tubular rod having two end portions, wherein the end portions of the tubular rod have central longitudinal axes;

at least one body engaging member having a longitudinal bore rotatable mounted on the first end portion of the tubular rod, wherein the first end portion of the body engaging member is rotatable about the longitudinal axis of the first end portion of the rod; and a cable connector fixably mounted to the second end of the tubular rod;

wherein the asymmetrically shaped tubular rod is an angulated non-planar J-shaped tubular rod having a first end portion forming the stem of the J, and at least three segments forming the loop of the J, wherein the second end portion of the rod forms the last segment of the loop of the J and wherein the second end portion and the adjacent segment lie in a plane, and wherein the first end portion and the first segment lie in a plane at an angle to the plane in which the second end portion and the adjacent segment lie;

wherein the tubular rod further comprises four linear segments wherein the first linear segment corresponds to the first end portion and to the stem of the J; the second linear segment corresponds to the initial segment of the loop of the J, the third linear segment corresponds to the middle of the J; the fourth linear segment corresponds to the end of the loop of the J and to the second end portion of the rod, and wherein the third and fourth linear segments lie in a first plane at an angle to a second plane in which the first and second segments lie;

wherein the first segment and the fourth segment have an outer end and an inner end, wherein the outer ends correspond to the ends of the rod; and wherein the rod has a three dimensional central longitudinal axis formed by the longitudinal axes of the portions of the rod, wherein the central longitudinal axis of the tubular rod intersect five points, wherein point one is the point at the outer end of the fourth segment; point two is the bending point between the fourth segment and the third segment; point three is the bending point between the third segment and the second segment; point four is the bending point between the second segment and the first segment; point five is the point at the outer end of the first segment; and wherein point one has the Cartesian coordinates (x,y,z) (0.000, 0.000, 0.000); point two has the Cartesian coordinates of about (0.000, 2.056, 0.000); point three has the Cartesian coordinates of about (2.376, 3.912, 0.000); point four has the Cartesian coordinates of about (3.458, 4.421, −2.802); and point five has the Cartesian coordinates of about (3.638, −1.588, −8.106).

6. A body engaging assembly for actuating a cable-drawn exercise device, comprising:

a three dimensional tubular rod having two end portions, wherein each portion of the rod has a longitudinal axis and wherein the rod has a three dimensional central longitudinal axis formed by the longitudinal axes of the portions of the rod;

at least one body engaging member having a longitudinal bore which telescopically receives the first end portion of the tubular rod, wherein the body engaging member is rotatable about the longitudinal axis of the first end portion of the tubular rod;

a cable connector attached to the second end of the tubular rod, and wherein the central longitudinal axis of the tubular rod intersects five points, wherein point one is the point at the outer end of the fourth segment, point two is the bending point between the fourth segment and the third segment, point three is the bending point between the third segment and the second segment, point four is the bending point between the second segment and the first segment, point five is the point at the outer end of the first segment, and wherein point one has the Cartesian coordinates (x,y,z) (0.000, 0.000, 0.000), point two has the Cartesian coordinates of about (5.5, 5.5, 0.0), point three has the Cartesian coordinates of about (9.0, 4.0, 9.0), point four has the Cartesian coordinates of about (12.5, 5.5, 0.0), and point five has the Cartesian coordinates of about (18.0, 0.0, 0.0).

7. A body engaging assembly for actuating a cable-drawn, exercise device, comprising:

an asymmetrically shaped tubular rod having two end portions, wherein the end portions of the tubular rod have central longitudinal axes;

at least one body engaging member having a longitudinal bore rotatably mounted on the first end portion of the tubular rod, wherein the first end portion of the body engaging member is rotatable about the longitudinal axis of the first end portion of the rod; and a cable connector fixably mounted to the second end of the tubular rod;

wherein the asymmetrically shaped tubular rod is an angulated non-planar J-shaped tubular rod having a first end portion forming the stem of the J, and at least three segments forming the loop of the J, wherein the second end portion of the rod forms the last segment of the loop of the J and wherein the second end portion and the adjacent segment lie in a plane, and wherein the first end portion and the first segment lie in a plane at an angle to the plane in which the second end portion and the adjacent segment lie.

8. The body engaging assembly of claims 7, wherein the body engaging member further comprises a sleeve.

9. The body engaging assembly of claim 7, wherein the body engaging member further comprises at least one fabric strap, and wherein the longitudinal bore in the body engaging member is formed by one or more loops of fabric.

10. An exercise bar assembly of claim 7, wherein the body engaging assembly is adapted for use in exercises against cable-drawn variable resistance comprising smooth, unrestricted free range of motion movements.

11. The body engaging assembly of claim 7 wherein the tubular rod further comprises four linear segments wherein the first linear segment corresponds to the first end portion and to the stem of the J'; the second linear segment corresponds to the initial segment of the loop of the J, the third linear segment corresponds to the middle of the J; the fourth linear segment corresponds to the end of the loop of the J and to the second end portion of the rod, and wherein the third and fourth linear segments lie in a first plane at an angle to a second plane in which the first and second segments lie.

12. The body engaging assembly of claim 11 wherein the angle between the first segment and the second segment is substantially similar to 119.43°; the angle between the second segment and the third segment is substantially similar to 113.49°; and the angle between the third segment and the fourth segment is substantially similar to 127.99°.

13. The body engaging assembly of claim 12 wherein the angle between the first segment and the second segment is approximately 119.43°; the angle between the second segment and the third segment is approximately 113.49°; and the first plane lies at approximately a 127.99° angle with respect to the second plane.

14. The body engaging assembly of claim 11 wherein the first segment and the fourth segment have an outer end and an inner end, wherein the outer ends correspond to the ends of the rod; and wherein the rod has a three dimensional central longitudinal axis formed by the longitudinal axes of the portions of the rod, wherein the central longitudinal axis of the tubular rod intersect five points, wherein point one is the point at the outer end of said fourth segment; point two is the bending point between said fourth segment and said third segment; point three is the bending point between the third segment and the second segment; point four is the bending point between the second segment and the first segment; point five is the point at the outer end of the first segment; and wherein point one has the Cartesian coordinates (x,y,z) (0.000, 0.000, 0.000); point two has the Cartesian coordinates of about (0.000, 2.056, 0.000); point three has the Cartesian coordinates of about (−2.376, 3.912, 0.000); point four has the Cartesian coordinates of about (−3.458, 4.421, −2.802; and point five has the Cartesian coordinates of about (−3.638, −1.588, −8.106).

15. The body engaging assembly of claim 11 wherein the first segment and the fourth segment have an outer end and an inner end, wherein the outer ends correspond to the ends of the rod; and wherein the rod has a three dimensional central longitudinal axis formed by the longitudinal axes of the portions of the rod, wherein the central longitudinal axis of the tubular rod intersect five points, wherein point one is the point at the outer end of the fourth segment; point two is the bending point between the fourth segment and the third segment; point three is the bending point between the third segment and the second segment; point four is the bending point between the second segment and the said first segment; point five is the point at the outer end of the first segment; and wherein point one has the Cartesian coordinates (x,y,z) (0.000, 0.000, 0.000); point two has the Cartesian coordinates of about (0.000, 6.060, 0.000); point three has the Cartesian coordinates of about (1.676, 7.622, 0.000); point four has the Cartesian coordinates of about (4.106, 7.533, 0.150); and point five has the Cartesian coordinates of about (−3.745, 5.968, −3.864).

16. The body engaging assembly of claim 11 wherein the first segment and the fourth segment have an outer end and an inner end, wherein the outer ends correspond to the ends of the rod; and wherein the rod has a three dimensional central longitudinal axis formed by the longitudinal axes of the portions of the rod, wherein the central longitudinal axis of the tubular rod intersect five points, wherein point one is the point at the outer end of the fourth segment; point two is the bending point between the fourth segment and the third segment; point three is the bending point between the third segment and the second segment; point four is the bending point between the second segment and the first segment; point five is the point at the outer end of the first segment; and wherein point one has the Cartesian coordinates (x,y,z) (0.000, 0.000, 0.000); point two has the Cartesian coordinates of about (0.000, 6.060, 0.000); point three has the Cartesian coordinates of about (−1.676, 7.622, 0.000); point four has the Cartesian coordinates of about (−4.106, 7.533, 0.150); and point five has the Cartesian coordinates of about (−3.745, 5.968, 3.864).

* * * * *

UNITED STATES PATENT AND TRADEMARK OFFICE

CERTIFICATE OF CORRECTION

PATENT NO. : 5,842,961

DATED : December 1, 1998

INVENTOR(S) : James O Davis

It is certified that error appears in the above-identified patent and that said Letters Patent is hereby corrected as shown below:

On the cover page, [73] Assignee: delete "The Jim Davis Connection, LLC". and insert --HBOD, Inc.--

Signed and Sealed this

Thirty-first Day of August, 1999

*Attest:*

Q. TODD DICKINSON

*Attesting Officer*

*Acting Commissioner of Patents and Trademarks*